US007851663B2

(12) United States Patent
Abhari

(10) Patent No.: US 7,851,663 B2
(45) Date of Patent: Dec. 14, 2010

(54) PROCESS FOR PRODUCING SYNTHETIC PETROLEUM JELLY

(75) Inventor: Ramin Abhari, Bixby, OK (US)

(73) Assignee: Syntroleum Corporation, Tulsa, OK (US)

( * ) Notice: Subject to any disclaimer, the term of this patent is extended or adjusted under 35 U.S.C. 154(b) by 756 days.

(21) Appl. No.: 11/787,370

(22) Filed: Apr. 16, 2007

(65) Prior Publication Data

US 2008/0253936 A1 Oct. 16, 2008

(51) Int. Cl.
*C10L 5/00* (2006.01)

(52) U.S. Cl. ..... 585/9; 585/13; 208/27; 208/59; 208/108; 208/268

(58) Field of Classification Search ..... 585/17, 585/18, 9, 13; 208/108, 27, 59, 268
See application file for complete search history.

(56) References Cited

U.S. PATENT DOCUMENTS 1,791,926 A * 2/1931 Gallagher ..... 208/268
3,764,537 A 10/1973 Macleod ..... 252/56
3,843,511 A 10/1974 Selwitz ..... 208/120
4,388,244 A 6/1983 Carlos
4,594,172 A * 6/1986 Sie ..... 508/312
5,037,528 A * 8/1991 Garwood et al. ..... 208/27
5,110,445 A * 5/1992 Chen et al. ..... 208/96
5,306,416 A * 4/1994 Le et al. ..... 208/108
5,976,560 A 11/1999 Han et al.
6,179,993 B1 * 1/2001 Seimandi et al. ..... 208/27
6,881,776 B2 4/2005 Butuc ..... 524/284
2004/0192979 A1 * 9/2004 Matthai et al. ..... 585/16

* cited by examiner

*Primary Examiner*—N. Bhat

(57) ABSTRACT

A method for producing petroleum jelly from hydrocarbons. The method converts the hydrocarbon source into a synthesis gas. The synthesis gas is converted into at least a light-hydrocarbons stream and a heavy-hydrocarbons stream, which both include a plurality of paraffins and a plurality of olefins. The plurality of paraffins is reacted with the plurality of olefins in the presence of a dialkyl peroxide initiator to form the petroleum jelly.

14 Claims, 7 Drawing Sheets
(1 of 7 Drawing Sheet(s) Filed in Color)

PROCESS FOR PRODUCING SYNTHETIC PETROLEUM JELLY

FIELD OF THE INVENTION

This invention relates to a system and process for producing petrolatum and, more specifically, to a system and process for producing petroleum jelly from a natural gas source.

BACKGROUND OF THE INVENTION

Petroleum jelly (a.k.a. petrolatum) is commonly used by itself or as an ingredient for many personal care products such as creams, lotions, and makeup (lipstick, etc.). These, as well as a number of other petroleum jelly applications, require compliance with "direct food contact" regulations.

Presently, petroleum jelly is manufactured from the heaviest crude oil refinery fraction, known as "vacuum residue." The high boiling carcinogenic components of crude oil, which are known as polynuclear aromatics and which include asphaltenes and polyaromatic hydrocarbons, tend to be concentrated in this petroleum fraction. Therefore, a number of cleanup steps are required to meet the stringent requirements of a product used for direct skin and mouth contact. Although not a comprehensive list, these cleanup steps can include propane deasphalting, hydrogenation, solvent dewaxing, and fixed-bed adsorption (e.g., using bauxite, carbon). Despite all these cleanup methods, commercial petroleum jelly still contains several parts-per-million polynuclear aromatics components. For this reason, petroleum jelly has been listed as a probable human carcinogen in the European Union's Dangerous Substances Directive, and its use in cosmetics has been limited for this reason. According to the website http://www.health-report.co.uk the European Union's Dangerous Substances Directive includes the following caveat: "The classification as a carcinogen need not apply if the full refining history is known and it can be shown that the substance from which it is produced is not a carcinogen."

Clearly, there is a desire for a petroleum jelly manufacturing process based on a clean, carcinogen-free hydrocarbon.

SUMMARY OF THE INVENTION

According to one embodiment of the present invention, a method for producing petroleum jelly from a natural gas source is disclosed. The method comprises converting the natural gas source into a synthesis gas. The synthesis gas is converted into at least a light-hydrocarbons stream and a heavy-hydrocarbons stream, which both include a plurality of paraffins and a plurality of olefins. The plurality of paraffins is reacted with the plurality of olefins in the presence of a dialkyl peroxide initiator to form the petroleum jelly.

According to another embodiment of the present invention, a method for producing petroleum jelly is disclosed. The method comprises generating a synthesis gas from one or more of a group including at least biomass, coal, or other hydrocarbon source. The synthesis gas is converted into at least a light-hydrocarbons stream and a heavy-hydrocarbons stream. The light-hydrocarbons stream and the heavy-hydrocarbons stream include a plurality of paraffins and a plurality of olefins. The plurality of paraffins is reacted with the plurality of olefins in the presence of a dialkyl peroxide initiator to form the petroleum jelly.

According to yet another embodiment of the present invention, a system for producing petroleum jelly from a natural gas source is disclosed. The system comprises a synthesis gas production system, a hydrocarbon conversion system, and a petroleum-jelly production system. The synthesis gas production system is adapted to produce a synthesis gas from at least the natural gas source. The hydrocarbon conversion system is adapted to produce heavier hydrocarbons from at least the synthesis gas, the heavier hydrocarbons containing at least a plurality of paraffins and a plurality of olefins. The petroleum-jelly production system is adapted to convert the produced heavier hydrocarbons into petrolatum. The petroleum-jelly production system includes (i) one or more storage tanks containing the heavier hydrocarbons produced by the hydrocarbon conversion system, (ii) one or more initiator storage tanks containing at least one dialkyl peroxide initiator, and (iii) a graft reactor in fluid communication with both the one or more storage tanks and the one or more initiator storage tanks. The graft reactor is adapted to mix at least a portion of the contents of the one or more storage tanks and at least a portion of the contents of the one or more initiator storage tanks to allow the plurality of paraffins and the plurality of olefins contained in the heavier hydrocarbons to form petrolatum in the presence of the at least one dialkyl peroxide initiator.

The above summary of the present invention is not intended to represent each embodiment, or every aspect, of the present invention. Additional features and benefits of the present invention are apparent from the detailed description, figures, and claims set forth below.

BRIEF DESCRIPTION OF THE DRAWINGS

The patent or application file contains at least one drawing executed in color. Copies of this patent or patent application publication with color drawings will be provided by the Office upon request and payment of the necessary fee.

Figure 1:
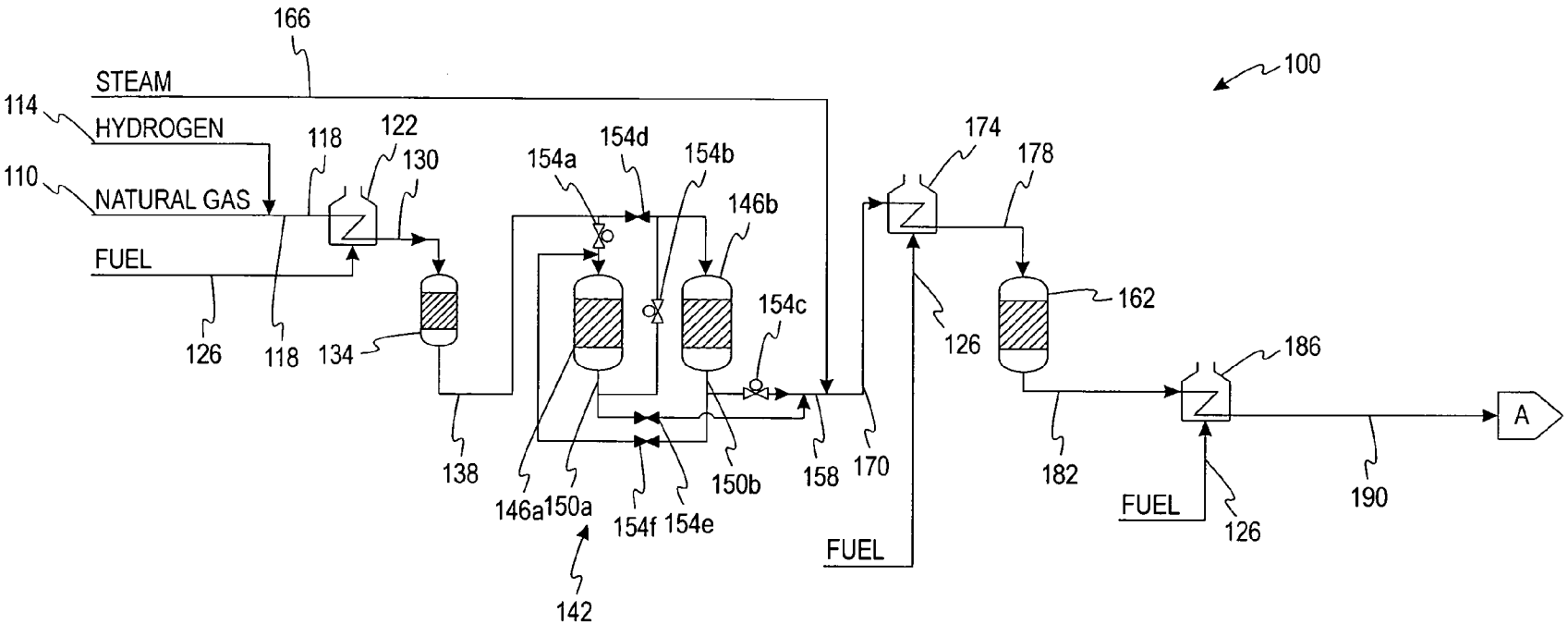
FIG. 1 is a process schematic of a natural-gas pretreatment system for heating and decontaminating natural gas, according to one embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION OF THE INVENTION

The present invention relates generally to the production of synthesis gas (syngas) from air and a natural-gas stream followed by the synthesis of heavier hydrocarbons from the syngas. It should be noted, however, that the syngas and heavier hydrocarbons may be generated from natural gas, coal, biomass, or other source of hydrocarbons. The biomass may be a renewable source of hydrocarbons. In some embodiments, the present invention relates to a system and process for producing petroleum jelly from the synthesized heavier hydrocarbons. The syngas is produced from a natural gas feedstock, which is inherently less toxic than the crude oil that has historically been used to manufacture petroleum jelly. More specifically, the natural gas feedstock is inherently less toxic than the "vacuum residue" fraction of crude oil. A Fischer-Tropsch process may be used to convert the syngas, which is produced from the natural gas feedstock, to linear n-paraffins and olefins in the $C_5$-$C_{50+}$ range. This syncrude composition resembles an oily wax. Furthermore, this syncrude, oily wax composition may be combined with other sources of synthetic wax, such as vegetable oils and animal fats, or otherwise prepared by blends of synthetic or other waxes with olefinic hydrocarbons.

The resultant syncrude can be treated with an organic peroxide at a temperature high enough to break down the peroxide into radicals. The radicals promote a coupling of graft reaction between the Fischer-Tropsch olefins and n-paraffins resulting in a product that is a synthetic petroleum jelly. The synthetic petroleum jelly may be fractionated and hydrogenated to meet the desired boiling point and color specifications.

Figure 3:
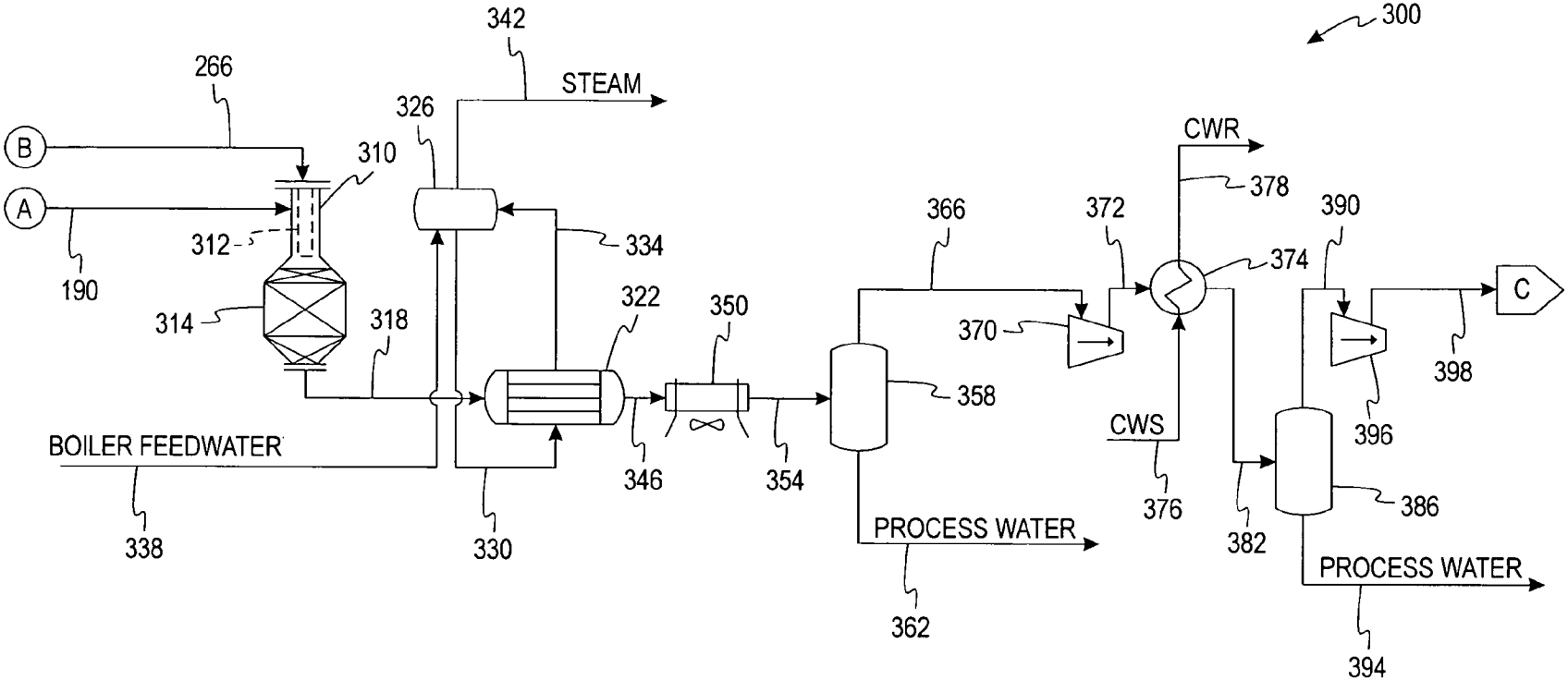
FIG. 3 is a process schematic of a syngas production system for producing a syngas from the decontaminated natural-gas stream of FIG. 1 and the desulfurized air stream of FIG. 2, according to one embodiment of the present invention.

Referring now to FIG. 1, a natural-gas pretreatment system 100 for heating and decontaminating a natural-gas stream 110 is illustrated according to one embodiment. A typical natural-gas stream 110 contains sulfur and other contaminants that should be removed prior to feeding the natural gas feedstock to an Autothermal Reformer (ATR) 310 (FIG. 3). A hydrogen-gas stream 114 is supplied to the natural-gas stream 110 and a resulting hydrogen-enriched, natural-gas stream 118 is heated in a furnace 122. The furnace 122 is fired by a fuel stream 126 supplied thereto. The fuel stream 126 may feed any suitable fuel to the furnace 122 sufficient to allow the furnace 122 to heat the hydrogen-enriched, natural-gas stream 118 to a desired temperature. Typically, the hydrogen-enriched natural-gas stream 118 is heated to a temperature range between about 500° F. (about 260° C.) and about 1000° F. (about 538° C.), and in some embodiments, to a temperature of about 750° F. (about 399° C.).

A resulting preheated, hydrogen-enriched, natural-gas stream 130 is then fed into a gas desulfurization reactor 134 to convert the sulfur compounds within the preheated, hydrogen-enriched, natural-gas stream 130 into hydrogen sulfide. The gas desulfurization reactor 134, in one embodiment, contains a catalyst bed that includes a cobalt-molybdenum catalyst on an alumina support. The cobalt-molybdenum catalyst, for example, reduces organic sulfur compounds to hydrogen sulfide and hydrolyzes both carbonyl sulfide and carbon sulfide into hydrogen sulfide. A resultant hydrogen-sulfide containing natural-gas stream 138 is then fed into a hydrogen-sulfide removal system 142.

The hydrogen-sulfide removal system 142 includes one or more adsorbent beds 146*a-b* containing material adapted to remove hydrogen sulfide from a natural-gas stream, such as zinc oxide. Where zinc oxide is utilized within the one or more adsorbent beds 146*a-b*, the reaction between the hydrogen sulfide in the hydrogen-sulfide containing natural gas stream 138 and the zinc oxide in the adsorbent beds 146*a-b* results in the formation of a zinc sulfide and water vapor. The zinc sulfide is retained in the adsorbent beds 146*a-b* and one or more desulfurized natural-gas streams 150*a-b* exit the reactors without the sulfur contaminants.

As illustrated in FIG. 1, two adsorbent beds 146*a-b* are positioned in series and allow for the substantially continuous removal of hydrogen sulfide from the hydrogen-sulfide containing stream 138. A plurality of valves 154*a-f* are utilized to control the flow of the hydrogen-sulfide containing stream 138 between the adsorbent beds 146*a-b*. By positioning a plurality of adsorbent beds 146*a-b* in series, a first adsorbent bed (e.g., 146*a*) can be used to remove the hydrogen sulfide from the hydrogen-sulfide containing stream 138 prior to the desulfurized gas stream (e.g., 150*a*) being fed to the second adsorbent bed (e.g., 146*b*). This process arrangement is referred to as a lead-lag arrangement. Once the zinc oxide within the first adsorbent bed 146*a* is substantially converted to zinc sulfide, thus becoming ineffective at removing the hydrogen sulfide, the hydrogen-sulfide containing stream 138 is redirected by the plurality of valves 154*a-f* to first enter the second adsorbent bed 146*b*. This allows the first adsorbent bed 146*a* to be dumped and recharged with fresh zinc oxide while the second adsorbent bed 146*b* removes the hydrogen sulfide from the hydrogen-sulfide containing stream 138. After bed 146*a* is recharged, it is put back in service downstream of 146*b*. The absorbent beds 146*a-b* can be alternated as the lead reactor so that a fresh zinc oxide bed is always in service for removal of the hydrogen sulfide.

A resulting desulfurized gas stream 158 exits the hydrogen-sulfide removal system 142. Following the removal of the sulfur from the natural gas stream 110, it may be necessary to convert the heavier hydrocarbons in the natural gas (e.g., ethane and heavier) to methane. Methane is less likely, by far, to produce carbon in the ATR 310 (FIG. 3). The conversion of the heavier hydrocarbons into methane (de-enrichment) may be facilitated, for example, by a pre-reformer 162. Prior to entering the pre-reformer 162, however, steam is added to the desulfurized gas stream 158 via a steam stream 166. The steam stream 166 may be provided, for example, from a boiler or other steam generation unit within or apart from the system for converting lighter hydrocarbons into heavier hydrocarbons. The desulfurized-gas/steam stream 170 is fed to a furnace 174 for heating the desulfurized-gas/steam stream 170 to the desired temperature prior to feeding the resultant heated, desulfurized-gas/steam stream 178 to the pre-reformer 162. According to one embodiment, the furnace 174 heats the desulfurized-gas/steam stream 170 to a temperature range between about 500° F. (about 260° C.) and about 1000° F. (about 538° C.), and in some embodiments, to a temperature of about 750° F. (about 399° C.).

The heated desulfurized-gas/steam stream 178 is fed to the pre-reformer 162 where the heated desulfurized-gas/steam stream 178 flows through a fixed catalyst bed that converts the heavier hydrocarbons to methane. This process may also produce detectable quantities of carbon monoxide, carbon dioxide, and hydrogen gas. Pre-reforming catalysts are commercially available and are manufactured by Johnson Matthey, Haldor Topsoe, and Süd Chemie.

A de-enriched gas/steam stream 182 exits the pre-reformer 162 and is then heated by a furnace 186 if necessary. The furnace 186 is fired by the fuel stream 126 supplied thereto. The fuel stream 126 may feed any suitable fuel to the furnace 186 sufficient to allow the furnace 186 to heat the de-enriched gas/steam stream 182 to a desired temperature. According to one embodiment, the de-enriched gas/steam stream 182 is heated to a temperature range between about 500° F. (about 260° C.) and about 1200° F. (about 649° C.), and in some embodiments, to a temperature range of about 800° F. (about 427° C.) and about 850° F. (about 454° C.). A resultant heated, de-enriched gas/steam stream 190 is then fed to the ATR 310 as will be further described with respect to FIG. 3.

Figure 2:
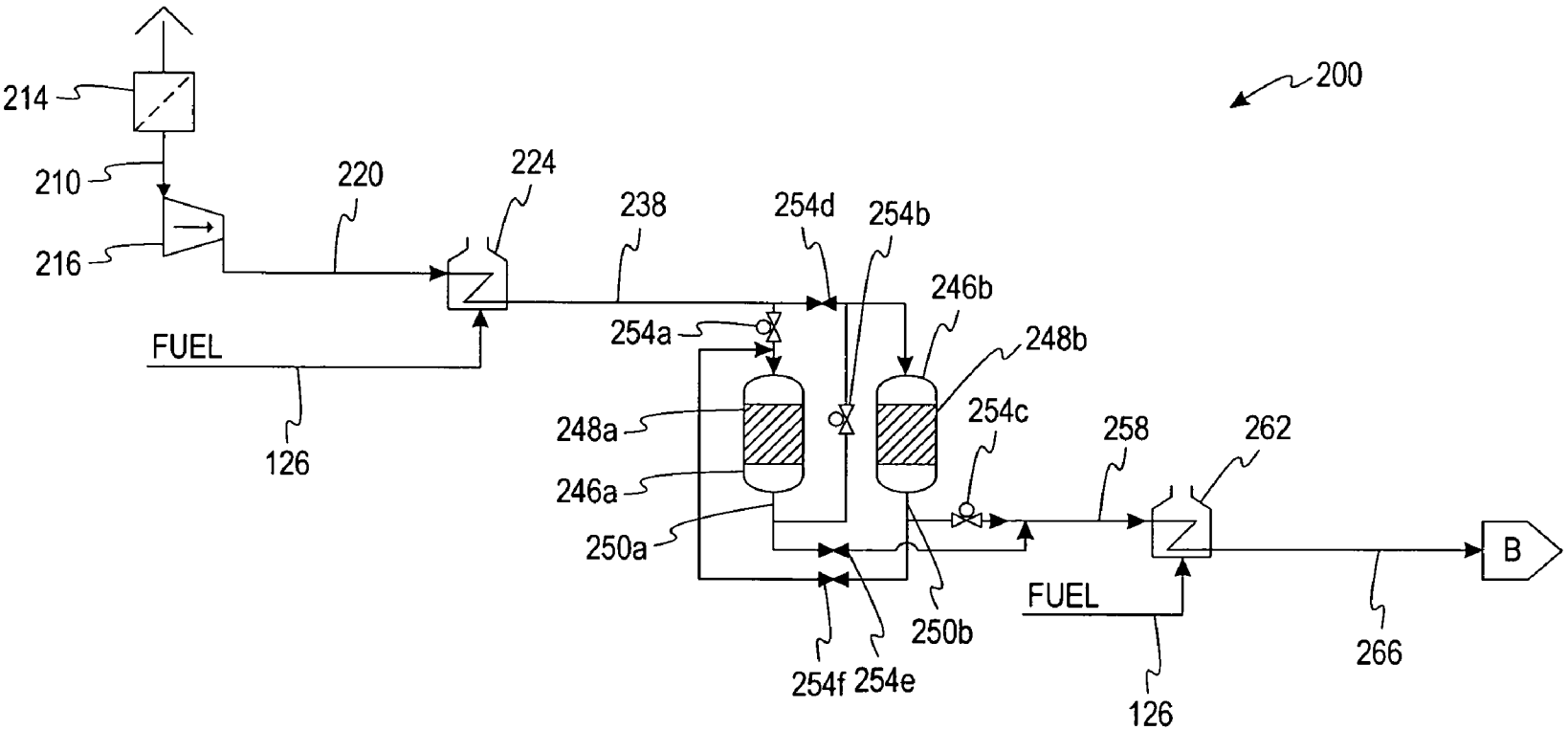
FIG. 2 is a process schematic of an air desulfurization system for heating, compressing, and desulfurizing an air stream, according to one embodiment of the present invention.

Turning now to FIG. 2, an air desulfurization system 200 is illustrated, according to one embodiment of the present invention. The air desulfurization system 200 is utilized to remove a majority of the sulfur contaminants from the air that will be supplied to the ATR 310 (FIG. 3) to produce a syngas. It is desirable to remove the sulfur contaminants from both the natural-gas stream 110 and an air stream 210 prior to feeding the streams to the ATR 310 because it is easier and more cost efficient to remove the sulfur contaminants from these streams than from a resultant syngas stream. However, the natural-gas stream 110 and/or the air stream 210 may be fed to the ATR 310 without removing the sulfur contaminants.

In the air desulfurization system 200, the intake for the air stream 210 is through an air inlet 214. The air inlet 214 allows atmospheric air to enter the air desulfurization system 200 where it can be processed and then provided to the ATR 310 (FIG. 3) to produce a syngas. The air inlet 214, in some embodiments, includes filtration or separation equipment to prevent rain, liquids, debris, particulates, or other undesirables from entering the air inlet 214. The air stream 210 is fed to an air compressor 216 that compresses the air stream 210 to a pressure from about 150 psig to about 400 psig while, in some embodiments, the air stream 210 is compressed from about 150 psig to about 200 psig. From the air compressor 216, a resultant compressed air stream 220 is conducted to a furnace 224. The furnace 224 is fired by the fuel stream 126 supplied thereto. The fuel stream 126 may feed any suitable fuel to the furnace 224 sufficient to allow the furnace 224 to heat the compressed air stream 220 to the desired temperature. Typically, the furnace 224 heats the compressed air stream to a temperature in the range of from about ambient temperature to about 1000° F. (about 538° C.). In some embodiments, the furnace 224 heats the compressed air stream 220 to a temperature in the range of from about 750° F. (about 399° C.) to about 850° F. (about 454° C.). In some of these embodiments, the furnace 224 heats the compressed air stream 220 to a temperature of approximately 800° F. (about 427° C.). In alternative embodiments, other types of heaters can replace the furnace 224. For example, a heat exchanger, a furnace coil heater, or another type of radiant or convection heater (not shown) may be used to heat the compressed air stream 220.

Figure 5:
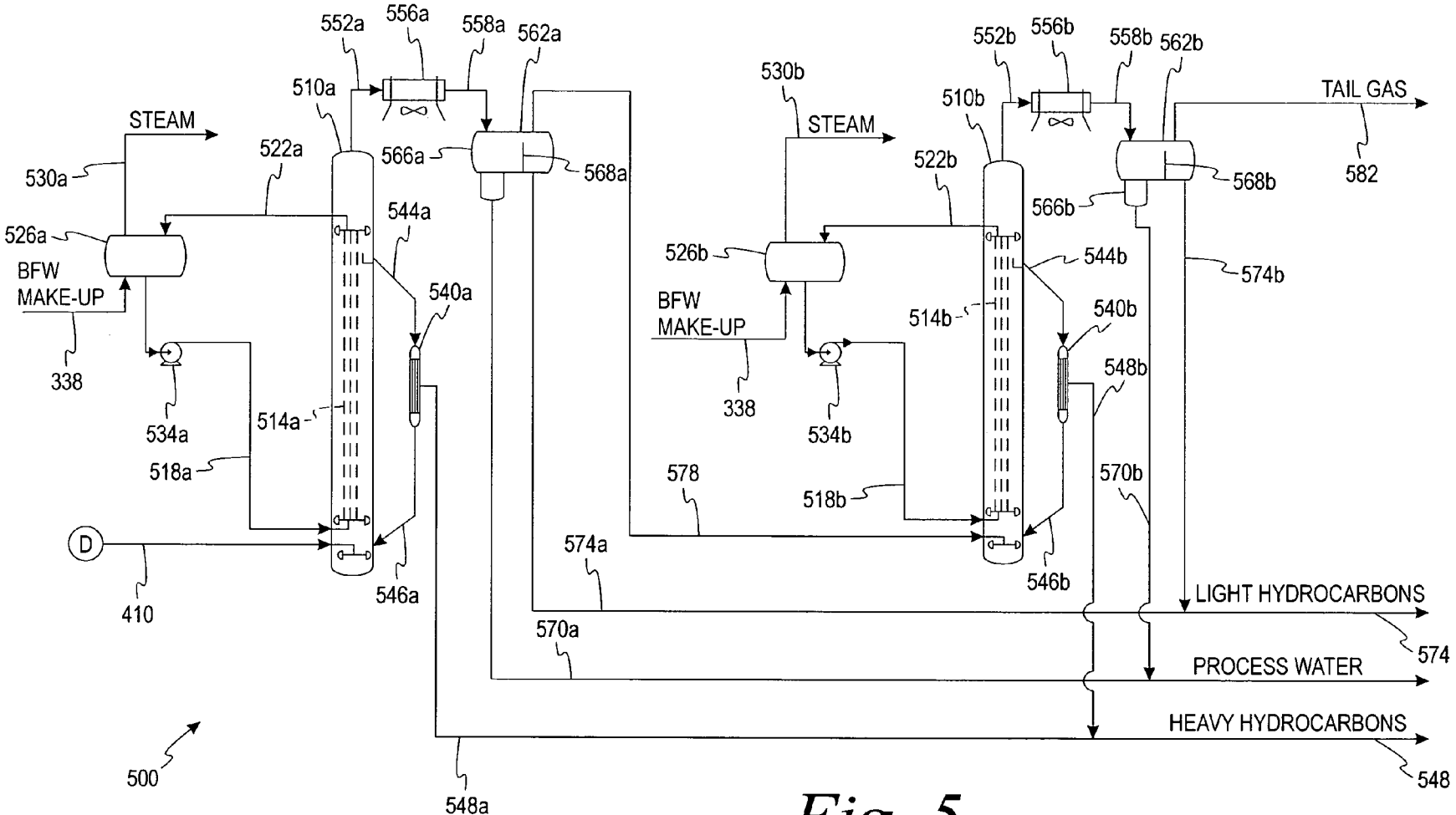
FIG. 5 is a process schematic of a hydrocarbon conversion system for the controlled reaction of synthesis gas (carbon monoxide and hydrogen) to produce heavier hydrocarbons, according to one embodiment of the present invention.

A resultant heated air stream 238 exits the furnace 224 and is fed to a first desulfurization reactor 246*a* in the illustrated embodiment. The heated air stream 238 generally includes detectable quantities of sulfur dioxide, the major sulfur contributor from the atmosphere. This potential sulfur contaminant should be removed from the heated air stream 238 prior to being fed to the ATR 310 (FIG. 3). As discussed below in connection with FIG. 3, by removing the sulfur dioxide prior to forming the syngas, the potential for contamination of the syngas stream utilized in a Fischer-Tropsch process is reduced. The removal of the sulfur contaminants from the syngas stream helps to increase the life of the catalyst and productivity of a hydrocarbon conversion system 500 (FIG. 5).

According to one embodiment, the first desulfurization reactor 246*a* has a fixed bed 248*a* therein that includes one or more metal oxides such as, for example, copper oxide. It is believed that the fixed bed 248*a* of copper oxide removes the sulfur dioxide from the heated air stream 238 by reacting with the sulfur oxide to form a copper sulfate in a solid form, according to the following reaction scheme:

$$CuO+SO_2+\tfrac{1}{2}O_2 \rightarrow CuSO_4$$

This reaction scheme highly favors the formation of copper sulfate at equilibrium, even where gaseous oxygen is at low levels. Thus, where oxygen levels are relatively high (e.g., <20% by volume), the formation of copper sulfate is even further favored. According to one embodiment, the oxygen level within the heated air stream 238 is approximately 21% by volume and, as such, favors the formation of the copper sulfate solid.

The fixed bed 248*a* of copper oxide can be selected from any appropriate commercially available catalyst or may be manufactured specifically for use in a particular air desulfurization system. For example, the copper oxide catalyst may be a commercially available, low temperature, shift conversion catalyst. These catalysts have a composition that typically has both copper oxide and zinc oxide on an alumina ($Al_2O_3$) support. The copper oxide is very finely dispersed resulting in a large, stable copper surface area and an inherently high activity. Manufacturers of this type of catalyst include Johnson Matthey, Haldor Topsoe, Süd Chemie, and Engelhard. These catalysts are typically manufactured to promote the water shift reaction of carbon monoxide to carbon dioxide and hydrogen gas ($CO+H_2O \leftrightarrow CO_2+H_2$). In this application, the catalyst operates in a reducing environment as a true catalyst. When used in an oxidizing environment in the presence of sulfur dioxide, the copper oxide acts as a chemical adsorbent and reacts with the sulfur dioxide and oxygen gas to produce copper sulfate. The copper sulfate formed, remains a solid on the catalyst, thus effectively removing the sulfur from the air stream being treated.

The copper oxide is consumed over time and the ability of the fixed bed 248*a* to remove sulfur dioxide from the air stream is a function of the quantity of catalyst in the fixed bed 248*a* similar to the zinc oxide used for the removal of hydrogen sulfide. However, unlike zinc sulfide, copper sulfate can be regenerated according to the following reaction:

$$CuSO_4+4H_2 \leftrightarrow CuO+3H_2O+H_2S$$

An economic evaluation is recommended to determine if it is cost effective to regenerate the copper oxide or if the bed should be dumped and recharged when it is spent. Regardless, with either option, a two bed system in a lead-lag configuration may be used such that one bed is always in service to remove the sulfur dioxide while the spent bed is being recharged or regenerated.

The fixed bed 248*a* desulfurizes approximately at least 8,000 gas hourly space velocities (GHSV). In some embodiments, the fixed bed 248*a* may remove a substantial amount of the sulfur dioxide from the heated air stream 238 from at least approximately 20,000 GHSV. Thus, as the amount of heated air being required by and, thus, fed into the ATR 310 (as described below in connection with FIG. 3) increases, so does the size of the fixed bed 248*a* containing the copper oxide catalyst.

An example of a lead-lag arrangement of fixed beds 248*a-b* is illustrated in FIG. 2, according to one embodiment. The heated air stream 238 is fed into a top portion of the first desulfurization reactor 246*a*. The heated air stream 238 moves through the fixed bed 248*a* of the copper oxide catalyst towards an outlet (not shown) located on a lower portion of the first desulfurization reactor 246*a*. As the heated air stream 238 moves through the fixed bed 248*a*, the sulfur dioxide forms copper sulfate and plates out of the heated air stream 238 and remains in the fixed bed 248*a*. A first desulfurized air stream 250*a* exits the first desulfurization reactor 246*a* via the outlet and is fed, in some embodiments, to a second desulfurization reactor 246*b* containing the fixed bed 248*b* of desulfurization catalyst such as a metal oxide.

As illustrated, the first desulfurization reactor 246*a* and the second desulfurization reactor 246*b* are positioned in series and allow for the substantially continuous desulfurization of the heated air stream 238. A plurality of valves 254*a-f* are positioned so as to direct the heated air stream 238 to either the first desulfurization reactor 246*a* or the second desulfurization reactor 246*b*. The plurality of valves 254*a-f* then direct the exiting desulfurized air stream to either the second desulfurization reactor 246*b* or the first desulfurization reactor 246*a*, respectively.

As illustrated in FIG. 2, the heated air stream 238 is fed first to the first desulfurization reactor 246*a* through the open valve 254*a*. The first desulfurized air stream 250*a* exits the first desulfurization reactor 246*a* and travels through the open valve 254*b* before being fed to the second desulfurization reactor 246*b*. The first desulfurized air stream 250*a* proceeds through the second desulfurization reactor 246*b* and a second desulfurized air stream 250*b* exits the second desulfurization reactor 246*b*. The second desulfurized air stream 250*b* then travels through valve 254*c* and forms a desulfurized air stream 258.

A detection mechanism (not shown) is provided to determine the concentration of sulfur within the first desulfurized air stream 250*a*. Typical detection mechanisms are capable of detecting sulfur dioxide levels in excess of 10 ppb. Standard detection mechanisms such as a sulfur speciated gas chromatograph available from ANTEK can be utilized by the present invention.

The detection mechanism monitors the sulfur dioxide levels within the first desulfurized air stream 250*a* exiting the first desulfurization reactor 246*a*. If the sulfur dioxide level within the first desulfurized air stream 250*a* is below a detectable level or, in alternative embodiments, a predetermined threshold level, the first desulfurized air stream 250*a* proceeds to the second desulfurization reactor 246*b*. The desulfurized air stream 250*a* proceeds through the fixed bed 248*b* and exits the second desulfurization reactor 246*b* forming a second desulfurized air stream 250*b*. The second desulfurization reactor 246*b* potentially, though not necessarily, removes additional amounts of sulfur dioxide from the first desulfurized air stream 250*a* as the first desulfurized air stream 250*a* moves through the second desulfurization reactor 246*b*.

Alternatively, if the sulfur dioxide level within the first desulfurized air stream 250*a* is above the detectable or, in alternative embodiments, the predetermined threshold level, the detection mechanism sends a notification to the control circuitry (not shown) that the fixed bed 248*a* of metal oxide is no longer desulfurizing the heated air stream 238 at acceptable levels. The control circuitry or operator closes the valve 254*a* temporarily and the remaining heated air stream 238 in the first desulfurization reactor 246*a* is allowed to exit the first desulfurization reactor 246*a*. The first desulfurized air stream 250*a* proceeds to the second desulfurization reactor 246*b* where additional amounts of sulfur dioxide are purged from the first desulfurized air stream 250*a*.

In some embodiments, once the remaining first desulfurized air stream 250*a* has exited the second desulfurization reactor 246*b*, the valve 254*d* is opened so as to feed the heated air stream 238 directly into the second desulfurization reactor 246*b*. At the same time, the valves 254*b* and 254*c* are closed, whereas valves 254*e* and 254*f* are opened. Thus, when the heated air stream 238 is being fed directly to the second desulfurization reactor 246*b*, the valves 254*d*, 254*e*, and 254*f* are open while the valves 254*a*, 254*b*, and 254*c* are closed.

In alternative embodiments, however, the valve 254*d* is opened and the valve 254*a* is closed as soon as the detection mechanism detects a level of sulfur dioxide above detectable or threshold levels.

Once the valve 254*d* has been opened, the heated air stream 238 is directly fed to the second desulfurization reactor 246*b* through the valve 254*d*. The metal oxide provided on the fixed bed 248*b* removes at least a portion of the sulfur dioxide from the heated air stream 238. The second desulfurized air stream 250*b* exits the second desulfurization reactor 246*b* and travels through the valve 254*f* before being fed to the first desulfurization reactor 246*a*. The second desulfurized air stream 250*b* then exits the first desulfurization reactor 246*a* and travels through the valve 254*e* and forms the desulfurized air stream 258.

A detection mechanism (not shown) monitors the sulfur dioxide levels within the second desulfurized air stream 250*b* exiting the second desulfurization reactor 246*b*. The heated air stream 238 continues to be fed directly to the second desulfurization reactor 246*b* until the detection mechanism detects sulfur dioxide levels that are in excess of acceptable levels. The detection mechanism then sends a notification to the control circuitry and the heated air stream 238 is redirected to the first desulfurization reactor 246*a* prior to being fed to the second desulfurization reactor 246*b*.

The above-described desulfurization scheme provides the ability to continuously desulfurize an air stream to prevent unacceptable levels of sulfur dioxide from reaching the ATR 310 (as described below in connection with FIG. 3) and potentially reaching the Fischer-Tropsch catalyst.

In alternative embodiments, however, a single desulfurization reactor may be utilized. In these embodiments, the heated air stream 238 is not fed into the desulfurization reactor once the metal oxide or catalyst has become ineffective at removing the detectable or threshold quantities of sulfur dioxide. The heated air steam is only fed to the desulfurization reactor after the ineffective metal oxide or catalyst has been replaced or regenerated.

The desulfurized air stream 258 is fed to a furnace 262 fired by the fuel stream 126 that is supplied thereto. The fuel stream 126 may feed any suitable fuel to the furnace 262 sufficient to allow the furnace 262 to heat the desulfurized air stream 258 to a desired temperature. Typically, the furnace 262 heats the compressed air stream to a temperature in the range of from about 500° F. (about 260° C.) to about 1000° F. (about 538° C.). In some embodiments, the furnace 262 heats the desulfurized air stream 258 to a temperature in the range of from about 800° F. (about 427° C.) to about 850° F. (about 454° C.). In alternative embodiments, other types of heaters can replace the furnace 262. For example, a heat exchanger, a furnace coil heater, or another type of radiant or convection heater may be used to heat the desulfurized air stream 258. A resultant heated, desulfurized air stream 266 exits the furnace 262 and is fed to the ATR 310 (FIG. 3) as will be described below.

Referring also to FIG. 3, a system and method for producing a syngas is illustrated, according to one embodiment. Within the syngas production system 300, the heated, de-enriched gas/steam stream 190 (from the natural gas pretreatment system of FIG. 1) and the heated, desulfurized air stream 266 (from the air desulfurization system of FIG. 2) are fed to a syngas generator, such as the ATR 310. Both the heated, de-enriched gas/steam stream 190 and the heated, desulfurized air stream 266 have previously been desulfurized (FIGS.

1-2) prior to being fed to the ATR 310. The ATR 310 includes a gas and air mixer 312 connected to one end of the ATR 310. A bed of steam reforming catalyst 314, which typically contains nickel, is disposed within the ATR 310 at the end opposite the gas and air mixer 312. The bed of steam reforming catalyst 314 can be any of the noble or non-noble metal supported steam reforming catalysts readily available from numerous suppliers. Nickel on alumina is an example of such a catalyst. Suitable catalysts are well known in the art and are available from several sources, including Johnson Matthey, Haldor Topsoe, Süd Chemie, or Engelhard.

The bed of steam reforming catalyst 314 is covered by a layer of inert support material. The inert support layer prevents the back-radiation of heat from the support zone into the incoming heated, de-enriched gas/steam stream 190. The quantity of catalyst within the bed of steam reforming catalyst 314 corresponds to a gas hourly space velocity of about 5,000 to about 40,000 based on standard cubic feet per hour of the total feed gas. In some embodiments, the quantity of catalyst corresponds to a GHSV of about 8,000 to about 20,000 based on the total feed flow. The quantity of the inert support material is at least the minimum required to prevent excessive radiant heat transfer into the bulk stream. That is, the inert support material is loaded to a depth in which the top layer of the support remains at the same temperature as the incoming heated, de-enriched gas/steam stream 190, e.g., about 800° F. (about 427° C.) to about 850° F. (about 454° C.). For example, the quantity of the inert support material may be an amount sufficient to cover the bed of steam reforming catalyst 314 to a depth of about six inches to about twelve inches.

The ATR 310 may be a refractory-lined carbon steel vessel. Optionally, steam, carbon dioxide, or both may be introduced into the ATR 310 to assist in the formation of carbon monoxide and hydrogen gas within the ATR 310. The ATR 310 may be operated with a pressure between about 50 psig and about 500 psig. Typically, the ATR 310 is operated between about 100 psig and about 150 psig.

In the operation of the ATR 310, the heated, de-enriched gas/steam stream 190 is intimately mixed with the heated, desulfurized air stream 266 in the gas and air mixer 312 above the inert support material. The near homogeneous air/gas/steam mixture passes from the gas and air mixer 312 through the inert support material and into the steam reforming catalyst bed 314, whereby the combustion reaction takes place within the ATR 310. The combustion reaction is carried out at a temperature in the range of from about 1500° F. (about 815° C.) to about 2500° F. (about 1371° C.) under sub-stoichiometric conditions whereby the light hydrocarbons within the ATR 310 are partially oxidized. A resultant syngas stream 318 including nitrogen, unreacted light hydrocarbons, hydrogen gas, and carbon monoxide is produced by the ATR 310.

Due to the heat of reaction within the ATR 310, the syngas stream 318 exits the ATR 310 at a temperature of between about 1500° F. (about 815° C.) to about 2500° F. (about 1371° C.) and typically, at about 1800° F. (about 982° C.). The syngas stream 318 is cooled rapidly within a quench boiler 322 such that the syngas stream 318 has little residence time exposed to metal materials (e.g., to avoid "metal dusting"). The quench boiler 322 typically cools the syngas stream 318 to a temperature range of between about 400° F. (about 204° C.) to about 650° F. (about 343° C.) and in some embodiments, to about 550° F. (about 288° C.).

The syngas stream 318 is cooled within the quench boiler 322 by passing the syngas stream 318 through tubes carrying steam. The tubes are arranged in a bundle contained in a process quench boiler vessel. Boiler feed water (BFW) is supplied from a steam drum 326 via a BFW feed line 330. The tube bundle is completely submerged in boiler feedwater supplied by the BFW feed line 330. The BFW temperature is near its bubble point and enters the bottom of the quench boiler 322 and flows upward through the tube bundle. Heat from the syngas stream 318 is transferred to the BFW, thus, cooling the syngas stream 318 and heating the BFW. Because the BFW entered the quench boiler 322 near its bubble point, the heat transferred to the BFW causes a portion of the BFW to vaporize (boil). The two-phase BFW and water vapor (steam) stream flow through the tube bundle and out of the quench boiler 322 into an outlet line 334 and back to the steam drum 326 where the water vapor (steam) is separated from the BFW. The produced steam leaves the steam drum 326 via a steam exhaust 342 and may be used by the overall process as a heat source. The steam drum 326 is supplied with additional water to create steam by a make-up BFW stream 338.

A cooled, syngas stream 346 exits the quench boiler 322 and is further cooled by an air-cooled heat exchanger 350, followed by a cooling water exchanger (optional). The cooled syngas stream 346 is cooled by the air-cooled heat exchanger 350, in the illustrated embodiment, to a temperature in the range of about 100° F. (about 38° C.) to about 150° F. (about 66° C.). A resultant further-cooled, syngas stream 354 is then fed into a first accumulator 358. The first accumulator 358 allows process water that has condensed due to the cooling of the syngas stream 318 to be removed via a process-water outlet 362. The removed process water may be reused by the overall process as desired. Depending on where the removed process water is to be reused by the system, the removed process water may undergo further treatment or decontamination prior to being reused.

A resultant separated syngas stream 366 exits the top of the first accumulator 358 and is compressed by a compressor 370. The compressor 370, in the illustrated embodiment, may compress the separated syngas stream 366 to a pressure of about 150 psig to about 450 psig, and in some embodiments, to a range between about 260 psig and about 420 psig. The syngas compression may require a multiple-stage compressor, as shown, to reach the desired Fischer-Tropsch reactor pressure. For a two-stage syngas compressor as shown, a resultant partially-compressed syngas stream 372 is cooled by a cooling-water heat exchanger 374. The cooling-water heat exchanger 374 transfers heat from the partially-compressed syngas stream 372 to a cooling water supply 376 supplied to the cooling-water heat exchanger 374. The temperature of the cooling water supply 376 increases and the cooling water supply 376 exits the cooling-water heat exchanger 374 via the cooling water return 378. Alternatively or additionally, an air-cooled heat exchanger could be used to cool the partially-compressed syngas stream 372. Where the cooling-water heat exchanger 374 is used, the partially-compressed syngas stream 372 is cooled to a temperature between about 80° F. (about 27° C.) and about 150° F. (about 66° C.), and typically to about 100° F. (about 38° C.). Alternatively, where an air-cooled heat exchanger is used, the partially-compressed syngas stream 372 is cooled to a temperature between about 100° F. (about 38° C.) and about 150° F. (about 66° C.), and typically to about 120° F. (about 49° C.) to about 130° F. (about 54° C.).

A resultant cool, partially-compressed syngas stream 382 exits the cooling-water hear exchanger 374 and is fed to a second accumulator 386. The second accumulator 386 facilitates the separation of the syngas from the process water that has condensed because of the cooling by the cooling-water heat exchanger 374. A resultant further-separated syngas stream 390 exits from a top portion of the second accumulator 386, while the separated process water exits from a bottom portion of the second accumulator 386 via a process-water outlet 394. The further-separated syngas stream 390 is then fed to a second-stage compressor 396 located downstream from the first compressor 370. The second-stage compressor 396 further compresses the further-separated syngas stream 390 to a pressure between about 350 psig to about 600 psig, and in some embodiments, to a pressure between about 400 psig and about 450 psig. A resultant high-pressure syngas stream 398 exits the second-stage compressor 396 and is then processed through a contaminant-removal system 400, as illustrated in FIG. 4.

Figure 4:
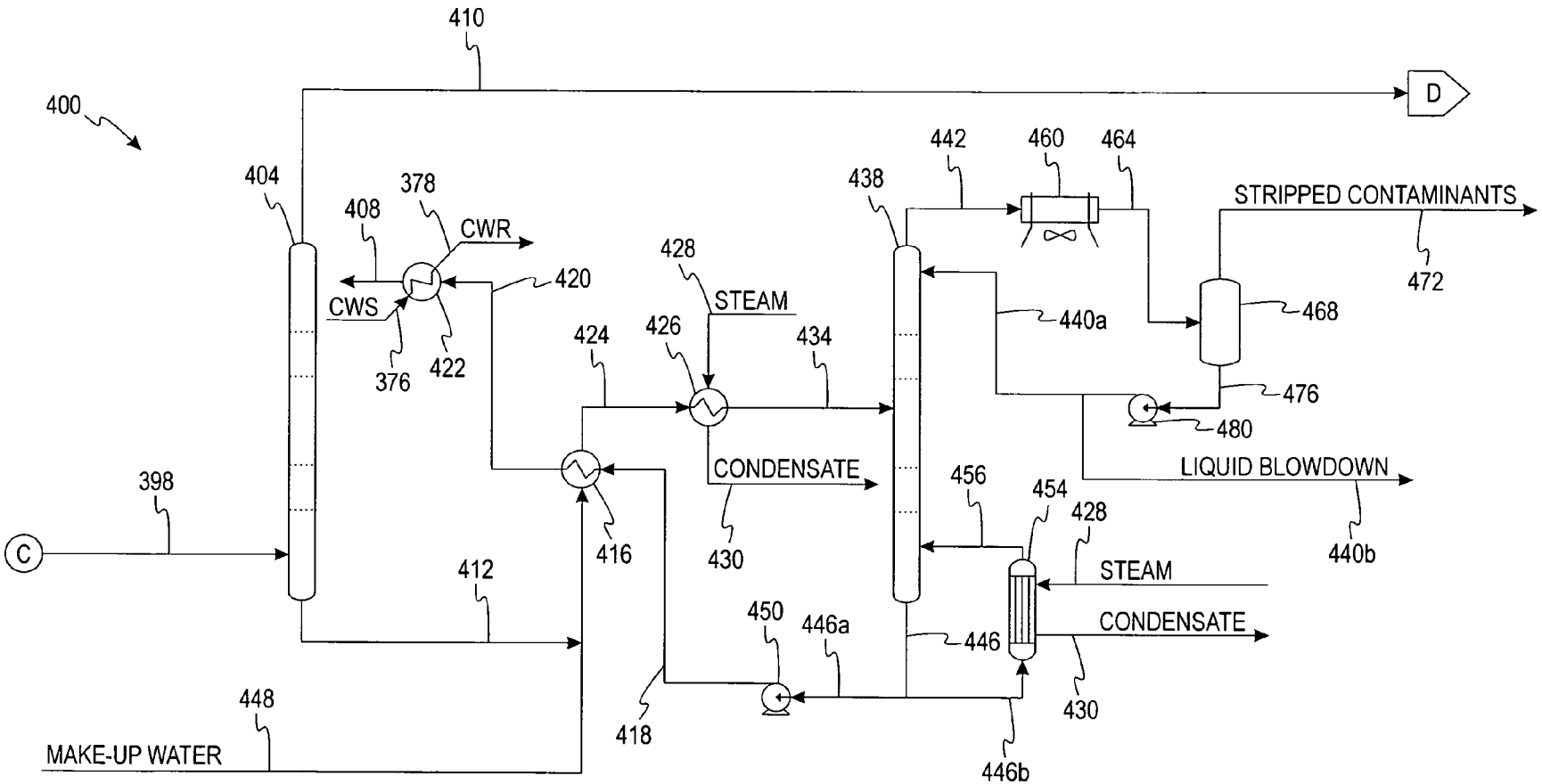
FIG. 4 is a process schematic of a contaminant removal system for the syngas stream of FIG. 3, according to one embodiment of the present invention.

Turning now to FIG. 4, the contaminant-removal system 400 is adapted to decontaminate the high-pressure syngas stream 398—produced by the syngas production system 300 of FIG. 3—according to one embodiment. According to some embodiments, the contaminant-removal system 400 utilizes a water-wash process for decontaminating the high-pressure syngas stream 398, as illustrated in FIG. 4. The conditions within the syngas production system 300 generally, and specifically the ATR 310, typically produce other contaminants such as reactive nitrogen compounds (e.g., ammonia and hydrogen cyanide) within the high-pressure syngas stream 398. While these nitrogen contaminants are not permanent poisons to Fischer-Tropsch catalysts, they do cause a loss in activity of the Fischer-Tropsch catalysts and it is desirable to remove these nitrogen contaminants from the high-pressure syngas stream 398. The contaminant-removal system 400 provides a decontamination process capable of removing a majority of the reactive nitrogen compounds from the high-pressure syngas stream 398. Though a water-wash process is illustrated with respect to FIG. 4, other fluid washing systems, or combinations of fluids with water can be utilized to wash and decontaminate the high-pressure syngas stream 398. For example, refrigerated or non-refrigerated glycols or alcohols may alternatively or additionally be used.

To remove these potential nitrogen contaminants, the high-pressure syngas stream 398 is first fed to a water-wash absorber 404. The water-wash absorber 404 may be a trayed or a packed-column absorber. Within the water-wash absorber 404, the high-pressure syngas stream 398 countercurrently contacts a water stream 408 fed into an upper portion of the water-wash absorber 404. The water stream 408 is fed into the water-wash absorber 404 above the feed of the high-pressure syngas stream 398. The high-pressure syngas stream 398 is fed into a lower portion of the water-wash absorber 404, thus, producing the countercurrent gas and liquid flows within the water-wash absorber 404. The high-pressure syngas stream 398 proceeds upward through the water-wash absorber 404 and contacts the water stream 408. A resultant water-washed syngas stream 410 exits the top of the water-wash absorber 404. The water-washed syngas stream 410 typically exits the water-wash absorber 404 with a temperature in the range of about 40° F. (about 4° C.) to about 160° F. (about 71° C.), and in some embodiments, between about 100° F. (about 38° C.) and about 120° F. (about 49° C.). The water-washed syngas stream 410 is then further processed through a hydrocarbon conversion system 500 as will be detailed below with respect to FIG. 5.

Similarly, the water stream 408 proceeds downward in the water-wash absorber 404 and contacts the high-pressure syngas stream 398. The contact between the water stream 408 and the high-pressure syngas stream 398 allows some of the nitrogen contaminants to be absorbed by the water stream 408 from the high-pressure syngas stream 398. A level control valve (not shown) is located in the outlet line from the water-wash absorber 404. The level control valve allows a portion of a resulting wash-water stream 412—which includes a majority of the nitrogen contaminants originally within the high-pressure syngas stream 398—to exit the water-wash absorber 404 to be further processed.

The water stream 408 is fed into the water-wash absorber 404 at a temperature in the range of about 40° F. (about 4° C.) to about 150° F. (about 66° C.), and in some embodiments, at about 100° F. (about 38° C.) to about 120° F. (about 49° C.). Generally, the temperature of the water stream 408 is kept as low as is economically feasible to facilitate the absorption of nitrogen contaminants by the water stream 408. A small amount of heat may be generated within the water-wash absorber 404 due to the physical absorption of the nitrogen contaminants. Thus, the resulting wash-water stream 412 generally has a temperature in the range of about 40° F. (about 4° C.) to about 180° F. (about 82° C.), and in some embodiments, between about 120° F. (about 49° C.) and about 150° F. (about 66° C.).

After exiting the water-wash absorber 404, the wash-water stream 412 is fed to a heat exchanger 416. A make-up water stream 448 is mixed with the wash-water stream 412 before it enters the heat exchanger 416. The heat exchanger 416 is also fed by a recirculated water stream 418 having a temperature of about 200° F. (about 93° C.) to about 300° F. (about 149° C.), and in some embodiments, between about 240° F. (about 116° C.) and about 250° F. (about 121° C.). The heat exchanger 416 allows the recirculated water stream 418 and the wash-water stream 412 to exchange heat thus, increasing the temperature of the wash-water stream 412 and decreasing the temperature of the recirculated water stream 418. A resulting cooled, recirculated water stream 420 exits the heat exchanger 416 and is then fed into a cooling-water heat exchanger 422.

The cooling-water heat exchanger 422 transfers heat from the cooled, recirculated water stream 420 to the incoming cooling water supply 376 supplied to the cooling-water heat exchanger 422. The temperature of the cooling water supply 376 increases and exits the cooling-water heat exchanger 422 via the cooling water return 378. The cooled, recirculated water stream 420 is further cooled by the cooling-water heat exchanger 422 to a temperature between about 80° F. (about 27° C.) and about 150° F. (about 66° C.), and typically to about 100° F. (about 38° C.) to about 120° F. (about 49° C.). A flow control valve (not shown) controls the wash-water flow to the water-wash absorber 404 to ensure that a sufficient quantity of wash water is delivered to the water-wash absorber 404 to absorb a desired amount of the nitrogen contaminants. The resultant water stream 408 may be additionally cooled by alternative or additional means if it is desirable or economically feasible to utilize cooler water. The water stream 408 is then fed into the water-wash absorber 404 as described above.

Similarly, a warm wash-water stream 424 results from the exchange of heat within the heat exchanger 416. The warm wash-water stream 424 is then fed to a stripper pre-heater 426 such as a steam-stream heat exchanger. The steam-stream heat exchanger, for example, transfers heat from a steam stream 428 to the warm wash-water stream 424 resulting in a condensate stream 430 exiting the heat exchanger. The stripper pre-heater 426 also results in a heated, wash-water stream 434 having a temperature in the range of about 190° F. (about 88° C.) to about 300° F. (about 149° C.), and in some embodiments, between about 200° F. (about 93° C.) and about 220° F. (about 104° C.). The resultant heated, wash-water stream 434 exits the stripper pre-heater 426 and is fed into a wash-water stripper 438.

The wash-water stripper 438 serves as a means to separate the nitrogen contaminants from the water stream by stripping the absorbed nitrogen contaminants from the heated, wash-water stream 434. The wash-water stripper 438 operates at a much lower pressure than the water-wash absorber 404. For example, the wash-water stripper 438 generally has an operating pressure between about 0 and about 50 psig and in some instances between about 3 to about 7 psig. The nitrogen contaminants absorbed by the cool, wash water at high pressure (e.g., 450 psig) in the water-wash absorber 404 are easily stripped from the heated, wash-water stream 434 at a low pressure (e.g., 5 psig) in the wash-water stripper 438.

The wash-water stripper 438 may be a trayed or a packed column having equilibrium stages that separate the nitrogen contaminants from the heated, wash-water stream 434. The heated, wash-water stream 434 enters the wash-water stripper 438 near the center of the trays or packed areas within the column. The number of actual trays or the height of packing equivalent to an equilibrium stage varies with the vapor and liquid loadings and the specific tray or packing selected. The desired purity of the stripped water leaving the wash-water stripper 438 may be used to determine the number of equilibrium stages desired within the wash-water stripper 438.

Any vapor (steam, vaporized nitrogen contaminants, etc.) in the heated, water-wash stream 434 flows upward through the wash-water stripper 438. The vapor from the entering heated, wash-water stream 434 combines with steam and nitrogen contaminant vapor generated by a stripper reboiler 454 and is stripped from the wash-water in the lower portion of the wash-water stripper 438. As the vapor rises through the upper portion of the wash-water stripper 438, it contacts a cooled water stream, stripper reflux 440*a*, generated by a stripper overhead condenser 460 and returned to the column via a stripper overhead accumulator 468 and a stripper reflux pump 480 through the stripper reflux 440*a* line. As the vapors flow upward and contact the cooled reflux, a portion of the steam in the rising vapor condenses and joins the reflux flowing down the wash-water stripper 438, while the nitrogen contaminants in the vapor and any recycled contaminants continue to rise until they exit the column as a stripper overhead stream 442.

The stripper overhead stream 442 enter the stripper overhead condenser 460. The stripper overhead condenser 460 may be an air cooler, a water cooler, or a combination of the two. The stripper overhead condenser 460 cools and condenses the majority of the water vapor in the stripper overhead stream 442. This cooled and partially condensed water stream and the nitrogen contaminants flow to the overhead accumulator 468 as a cooled, stripper overhead stream 464. The overhead accumulator 468 facilitates the separation of the vapor and the liquid within the cooled, stripper overhead stream 464. The vapor generally contains water vapor and stripped nitrogen contaminants. Typically, the liquid is primarily water with some absorbed nitrogen contaminants.

The vapor forms a stripped-contaminants stream 472 that exits from a top portion of the stripper-overhead accumulator 468. The liquid flows from the overhead accumulator 468 as a condensate stream 476 to the stripper reflux pump 480. The stripper reflux pump 480 pumps a portion of the condensate stream 476 back to the top of the wash-water stripper 438 through a stripper reflux line as stripper reflux 440*a*. A small portion of the liquid becomes a liquid blowdown and exits the system through blowdown line 440*b*. Liquid blowdown is taken from the stripper overhead because it contains the highest concentration of absorbed nitrogen contaminants, and thus, the blowdown reduces the nitrogen contaminant level in the recycled wash-water.

The liquid portion of the heated, wash-water stream 434 flows downward from the wash-water inlet. The liquid wash-water contacts a vapor stream generated by the stripper reboiler 454 as the heated, wash-water stream 434 flows downward within the wash-water stripper 438. The hot vapor strips the nitrogen contaminants from the wash water. As the wash water progresses down the wash-water stripper 438, it contains less nitrogen contaminants. When it reaches the bottom of the wash-water stripper 438 it has been stripped of most of the nitrogen contaminants and is ready to be recycled as wash water. The wash water exits the wash-water stripper 438 as a wash-water stream 446. The wash-water stream 446 splits and a portion 446*a* of the wash-water stream 446 is recycled to the water-wash absorber 404 via a stripper-bottoms pump 450. The remaining portion 446*b* of the wash-water stream 446 is delivered to the reboiler 454 where it is partially vaporized to generate the stripping steam and returned to the wash-water stripper 438 via a reboiler output stream 456.

According to one embodiment, the reboiler 454, which generates the stripping steam, is a heat exchanger with wash-water on one side and steam on the other. A steam stream 428 enters the reboiler 454 and is condensed as it exchanges heat with the remaining portion 446*b* of the wash-water stream 446 through a heat transfer surface, typically comprising a plurality of tubes. The latent heat of vaporization of the steam as it condenses is transferred through the heat transfer surface into the remaining portion 446*b* of the wash-water stream 446 to heat and partially vaporize the remaining portion 446*b* of the wash-water stream 446 entering the reboiler 454. After the steam stream 428 has partially vaporized the remaining portion 446*b* of the wash-water stream 446, a steam-condensate stream 430 exits the reboiler 454 via a steam-condensate line.

Turning now to FIG. 5, the hydrocarbon conversion system 500 for converting gaseous light hydrocarbons into heavier hydrocarbons is illustrated, according to one embodiment. The water-washed syngas stream 410—having a pressure of between about 350 psig to about 600 psig, and in some embodiments, a pressure between about 400 psig and about 450 psig, and a temperature between about 80° F. (about 27° C.) and 160° F. (about 71° C.), and in some embodiments between about 100° F. (about 38° C.) and about 120° F. (about 49° C.)—is fed into a lower portion of a first-stage Fischer-Tropsch reactor 510*a* (first-stage FTR). In the illustrated embodiment, the first-stage FTR 510*a* is a slurry bubble column reactor wherein the water-washed syngas stream 410 is partially converted into heavier hydrocarbons as the syngas stream flows up within the first-stage FTR 510*a*. The Fischer-Tropsch reactions for syngas conversion to paraffins (mainly n-paraffins) and olefins (mainly linear alpha olefins) are shown in the following two reactions respectively:

$$nCO+(2n+1)H_2 \rightarrow C_nH_{2n+2}+nH_2O$$

$$nCO+2nH_2 \rightarrow C_nH_{2n+n}H_2O$$

The hydrocarbons derived from the Fischer-Tropsch reaction may range from methane to high molecular weight paraffinic waxes containing more than one-hundred carbon atoms. In alternative embodiments, however, the first-stage FTR 510*a* may be a fixed bed, ebullating bed, fluidized bed, continuously stirred tank reactor, or any other suitable reactor.

In general, the slurry process in a slurry bubble reactor involves introducing the water-washed syngas stream 410 into a hot, reactive slurry located within the first-stage FTR 510*a*. The slurry includes Fischer-Tropsch product hydrocarbons (e.g., wax) and particulate Fischer-Tropsch catalyst. A portion of the Fischer-Tropsch product hydrocarbons are liquid at the reactor conditions so that the Fischer-Tropsch catalyst particles are dispersed therein, forming the slurry. The Fischer-Tropsch catalyst particles may be a standard Fischer-Tropsch catalyst as is known in the art. Fischer-Tropsch catalysts include those based upon, for example, cobalt, iron, ruthenium as well as other Group VIIIB transition metals or combinations of such metals for use in preparing both saturated and unsaturated hydrocarbons.

The Fischer-Tropsch catalyst may also include a support such as a metal-oxide support. Potential metal-oxide supports include, but are not limited to, silica, alumina, silica-alumina, or titanium oxides. For example, a cobalt catalyst on transition alumina with a surface area of approximately 100 $m^2/g$ to approximately 200 $m^2/g$ may be used in the form of spheres being approximately 50 μm to approximately 150 μm in diameter. The cobalt concentration on the support may be between about 5 wt % to about 30 wt %. Catalyst stabilizers and promoters may also be used within the slurry bubble reactor. The catalyst stabilizers include Group IIA or Group IIIB metals, while the promoters may include elements from Group VIII or Group VIIB.

The first-stage FTR 510*a* includes a cooling coil 514*a* for removing the heat of reaction resulting from the conversion of the water-washed syngas stream 410 into heavier hydrocarbons. By removing the excess heat created within the first-stage FTR 510*a*, the first-stage FTR 510*a* can be operated at a near constant temperature. The heat from the reaction is absorbed by the cooling coil 514*a* by feeding a water stream 518*a* having a temperature of about 10° F. (about 5° C.) to about 50° F. (about 28° C.) less than the average temperature of the FTR 510*a*. The water stream 518*a* is fed in a lower portion of the first-stage FTR 510*a*. The surface area and number of tubes forming the cooling coil 514*a* within the first-stage FTR 510*a* can vary depending on the temperature of the water stream 518*a* to be fed into the first-stage FTR 510*a* and the reaction temperature desired within the first-stage FTR 510*a*. By increasing the surface area or number of tubes forming the cooling coil 514*a*, the amount of heat absorption within the first-stage FTR 510*a* can be increased. The absorbed heat converts the water stream 518*a* entering the first-stage FTR 510*a* into a steam stream 522*a* that exits an upper portion of the first-stage FTR 510*a*.

The steam stream 522*a* is fed into a steam drum 526*a* where a steam exhaust stream 530*a* is allowed to exit the system. The steam exhaust stream 530*a* may be utilized elsewhere within the overall process, wherever steam is required, or may be exhausted from the system entirely. The BFW stream 338 is fed to the steam drum 526*a* as a substitute for the exhausted steam. The BFW stream 338 and any condensation from the steam stream 522*a* exits a lower portion of the steam drum 526*a* and is fed to the lower portion of the first-stage FTR 510*a* by a circulation pump 534*a*.

As the water-washed syngas stream 410 moves upward within the first-stage FTR 510*a*, a portion of the syngas is converted into heavier hydrocarbons. As discussed above, a portion of the heavier hydrocarbons produced within the first-stage FTR 510*a* are liquid (e.g., molten wax) at the operating conditions of the first-stage FTR 510*a*. The liquids typically include the heaviest of the converted hydrocarbons and can be withdrawn from the first-stage FTR 510*a* through a filter. The filter may be a side-arm (downcomer) filter 540*a* located external from the first-stage FTR 510*a* or, in alternative embodiments, may be within the first-stage FTR 510*a* itself.

In the illustrated embodiment, the side-arm filter 540*a* is attached to the first-stage FTR 510*a* via a wax conduit 544*a*. The wax conduit 544*a* allows the liquid hydrocarbons to exit the first-stage FTR 510*a* and be filtered out by the side-arm filter 540*a*. The side-arm filter 540*a* operates utilizing the natural circulation—from a top portion to a bottom portion—of the liquid hydrocarbons within the first-stage FTR 510*a*. This natural circulation is induced by the density difference between the three-phase reactor mixture (e.g., wax-catalyst-syngas) and the degassed wax-catalyst slurry.

The side-arm filter 540*a* is utilized to separate the liquid hydrocarbon product from the first-stage FTR 510*a* slurry. The slurry is returned to a lower portion of the first-stage FTR 510*a* via a slurry-return conduit 546*a*. A separated, heavy-hydrocarbon product stream 548*a* exits the side-arm filter 540*a* of the first-stage FTR 510*a*. The separated, heavy-hydrocarbon product stream 548*a* is removed from the hydrocarbon conversion system 500 and may be further processed as desired.

An overhead stream 552*a* exits the first-stage FTR 510*a* and is cooled by an air cooler 556*a* in the illustrated embodiment. The overhead stream 552*a* typically contains produced hydrocarbons (in gaseous form) as well as un-reacted gases such as carbon monoxide and hydrogen. The overhead stream 552*a* may further include inert gases (e.g., carbon monoxide and nitrogen) in addition to water vapor. The overhead stream 552*a* exits the first-stage FTR 510*a* at a temperature between about 400° F. (about 204° C.) and about 450° F. (about 232° C.) and is cooled by the air cooler 556*a* to a temperature of about 150° F. (about 66° C.) to about 90° F. (about 32° C.). Alternatively, or additionally, a water cooler or other suitable cooler may be utilized to cool the overhead stream 552*a* to the desired temperature.

The cooling of the overhead stream 552*a* causes some of the hydrocarbons and water vapor to condense out of the overhead stream 552*a*. A resultant three-phase stream 558*a* includes a liquid-hydrocarbon phase, a liquid-water phase, and a vapor phase that typically contains light, gaseous hydrocarbons, un-reacted gases, and inerts. The three-phase stream 558*a* is fed into a three-phase separator 562*a* that is adapted to separate the three phases of the three-phase stream 558*a*.

The three-phase separator 562*a* may be a horizontal separator, such as the separator illustrated in FIG. 5, or any other suitable separator. The three-phase stream 558*a* is fed into an inlet (not shown) located in an upper portion of the three-phase separator 562*a*. The three-phase separator 562*a* may include a momentum absorber at the inlet to redirect the three-phase stream 558*a*, thus, dissipating a portion of the energy of motion of the three-phase stream 558*a*.

The three-phase stream 558*a* is temporarily collected within the three-phase separator 562*a*. The liquid-water phase and the liquid-hydrocarbons phase collect in a lower portion of the three-phase separator 562*a* while the vapor phase collects in an upper portion. The liquid-water phase of the three-phase stream 558*a* collects at the bottommost portion 566*a* of the three-phase separator 562*a* while the liquid hydrocarbons phase is suspended atop the liquid water. The liquid water exits from the bottommost portion 566*a* of the three-phase separator 562*a* forming a process water stream 570*a*.

The three-phase separator 562*a* utilizes a spillover weir 568*a* to separate the liquid hydrocarbon phase from the liquid water phase. As the hydrocarbon liquids accumulate, the liquid level within the three-phase separator 562*a* raises. Once the liquid level reaches a predetermined height, the liquid hydrocarbons phase begins to spill over the spillover weir 568*a* and exits the three-phase separator 562*a* forming a light-hydrocarbons stream 574*a*. The light-hydrocarbons stream 574*a* can then be removed from the hydrocarbon conversion system 500 for further processing.

The remaining phase, the vapor phase, is demisted to remove any liquid droplets from the vapor phase. The demisted vapor exits an overhead portion of the three-phase separator 562*a* to form a vapor stream 578. The vapor stream 578 has a composition similar to that of the water-washed syngas stream 410, except the percentage of the various components within the vapor stream 578 differ from the water-washed syngas stream 410. For example, the percentages of carbon monoxide and hydrogen gas within the vapor stream 578 are typically much lower than their respective percentages in the water-washed syngas stream 410. The vapor stream 578 is then fed into a lower portion of a second-stage FTR The second-stage FTR 510*b* operates in a substantially similar manner as the first-stage FTR 510*b*. The second-stage FTR 510*b* includes a cooling coil 514*b* for removing the heat of reaction resulting from the conversion of the vapor stream 578 into heavier hydrocarbons. The heat from the reaction is absorbed by the cooling coil 514*b* by feeding a water stream 518*b* into a lower portion of the second-stage FTR 510*b* and through the cooling coil 514*b*. The water stream 518*b* is heated until it reaches its boiling point and then begins to boil and the latent heat of vaporization removes the heat of reaction. The steam pressure may be controlled to control the boiling point of the water stream 518*b* within the cooling coil 514*b*. The steam pressure is adjusted to control the temperature of the cooling coil 514*b* and maintain a temperature differential of about 10° F. (about 5° C.) to about 50° F. (about 28° C.) below the reactor temperature. The higher the temperature difference between the steam temperature and the reactor temperature, the greater the driving force for the heat transfer and can reduce the heat transfer area that is required. The absorbed heat converts the water stream 518*b* into a steam stream 522*b* that exits an upper portion of the second-stage FTR 510*b*.

The steam stream 522*b* is fed into a steam drum 526*b* where a steam exhaust stream 530*b* is allowed to exit the system. The BFW stream 338 is fed to the steam drum 526*b* as a substitute for the exiting steam exhaust stream 530*a*. The BFW stream 338 and any condensation from the steam stream 522*b* exit a lower portion of the steam drum 526*b* and are fed to the lower portion of the second-stage FTR 510*b* by a circulation pump 534*b*.

As the vapor stream 578 moves upward within the second-stage FTR 510*b*, a portion of the remaining carbon monoxide and hydrogen gas is converted into hydrocarbons. A wax can be withdrawn from the second-stage FTR 510*b* through a side-arm filter 540*b* attached to the second-stage FTR 510*b* via a wax conduit 544*b*. The side-arm filter 540*b* separates the liquid hydrocarbon products from the second-stage FTR 510*b* slurry. The slurry is returned to a lower portion of the second-stage FTR 510*b* via a slurry-return conduit 546*b*. A separated, heavy-hydrocarbon product stream 548*b* exits the side-arm filter 540*b* of the second-stage FTR 510*b*. The heavy-hydrocarbons stream 548*b* is mixed with the heavy-hydrocarbons stream 548*a* to form a heavy-hydrocarbons stream 548. The heavy-hydrocarbons stream 548 is comprised primarily of $C_{22+}$ paraffins and exits the hydrocarbon conversion system 500 for further processing. The heavy-hydrocarbon stream 548 can be further processed to produce a petroleum jelly as will be further described below with respect to FIG. 6.

An overhead stream 552*b* exits the second-stage FTR 510*b* and is cooled by an air cooler 556*b* in the illustrated embodiment. The overhead stream 552*b* typically contains the produced heavier hydrocarbons (in gaseous form) as well as un-reacted gases such as carbon monoxide and hydrogen. The overhead stream 552*b* may further include inert gases (e.g., carbon monoxide and nitrogen) in addition to water vapor. The overhead stream 552*b* exits the second-stage FTR 510*b* at a temperature between about 400° F. (about 204° C.) and about 450° F. (about 232° C.) and is cooled, in the illustrated embodiment, by the air cooler 556*b* to a temperature of about 150° F. (about 66° C.) to about 90° F. (about 32° C.).

The cooling of the overhead stream 552*b* causes some of the hydrocarbons and water vapor to condense out of the overhead stream 552*b*. A resultant three-phase stream 558*b* includes a liquid-hydrocarbons phase, a liquid-water phase, and a vapor phase that typically contains light, gaseous hydrocarbons, un-reacted gases, and inerts. The three-phase stream 558*b* is fed into a three-phase separator 562*b* that is adapted to separate the three phases of the three-phase stream 558*b*.

The three-phase stream 558*b* is fed into an inlet (not shown) located in an upper portion of the three-phase separator 562*b*. The three-phase stream 558*b* is temporarily collected within the three-phase separator 562*b*. The liquid-water phase and the liquid-hydrocarbons phase collect in a lower portion of the three-phase separator 562*b* while the vapor phase collects in an upper portion. The liquid-water phase of the three-phase stream 558*b* collects at the bottommost portion 566*b* of the three-phase separator 562*b* while the liquid-hydrocarbons phase is suspended atop the liquid water. The liquid water exits from the bottommost portion 566*b* of the three-phase separator 562*b* forming a process water stream 570*b* that exits the hydrocarbon conversion system 500 along with the process water stream 570*a*.

The three-phase separator 562*b* utilizes a spillover weir 568*b* to separate the liquid-hydrocarbons phase from the liquid-water phase. As the light-hydrocarbon liquids accumulate, the liquid level within the three-phase separator 562*b* raises. Once the liquid level reaches a predetermined height, the liquid-hydrocarbons phase begins to spill over the spillover weir 568*b* and exit the three-phase separator 562*b* forming a light-hydrocarbons stream 574*b*. The light-hydrocarbons stream 574*b* is mixed with the light-hydrocarbons stream 574*a* to form a light-hydrocarbons stream 574. The light-hydrocarbons stream 574 is comprised primarily of $C_4$-$C_{22}$ paraffins and $C_4$-$C_{10}$ olefins (mainly as alpha-olefins such as 1-heptene and 1-octene) and exits the hydrocarbon conversion system 500 for further processing. The light-hydrocarbons stream 574 can be further processed to produce a petroleum jelly as will be further described below with respect to FIG. 6.

The remaining phase, the vapor phase, is demisted to remove any liquid droplets from the vapor phase. The demisted vapor exits an overhead portion of the three-phase separator 562*b* to form a tail-gas stream 582. The tail-gas stream 582 has a composition similar to that of the vapor stream 578, except the percentage of the various components within the tail-gas stream 582 differ from the vapor stream 578. For example, the percentages of carbon monoxide and hydrogen gas within the tail-gas stream 582 are typically much lower than their respective percentages in the vapor stream 578. The tail-gas stream 582 exits the hydrocarbon conversion system 500 and may be discarded or utilized further as desired.

Figure 6:
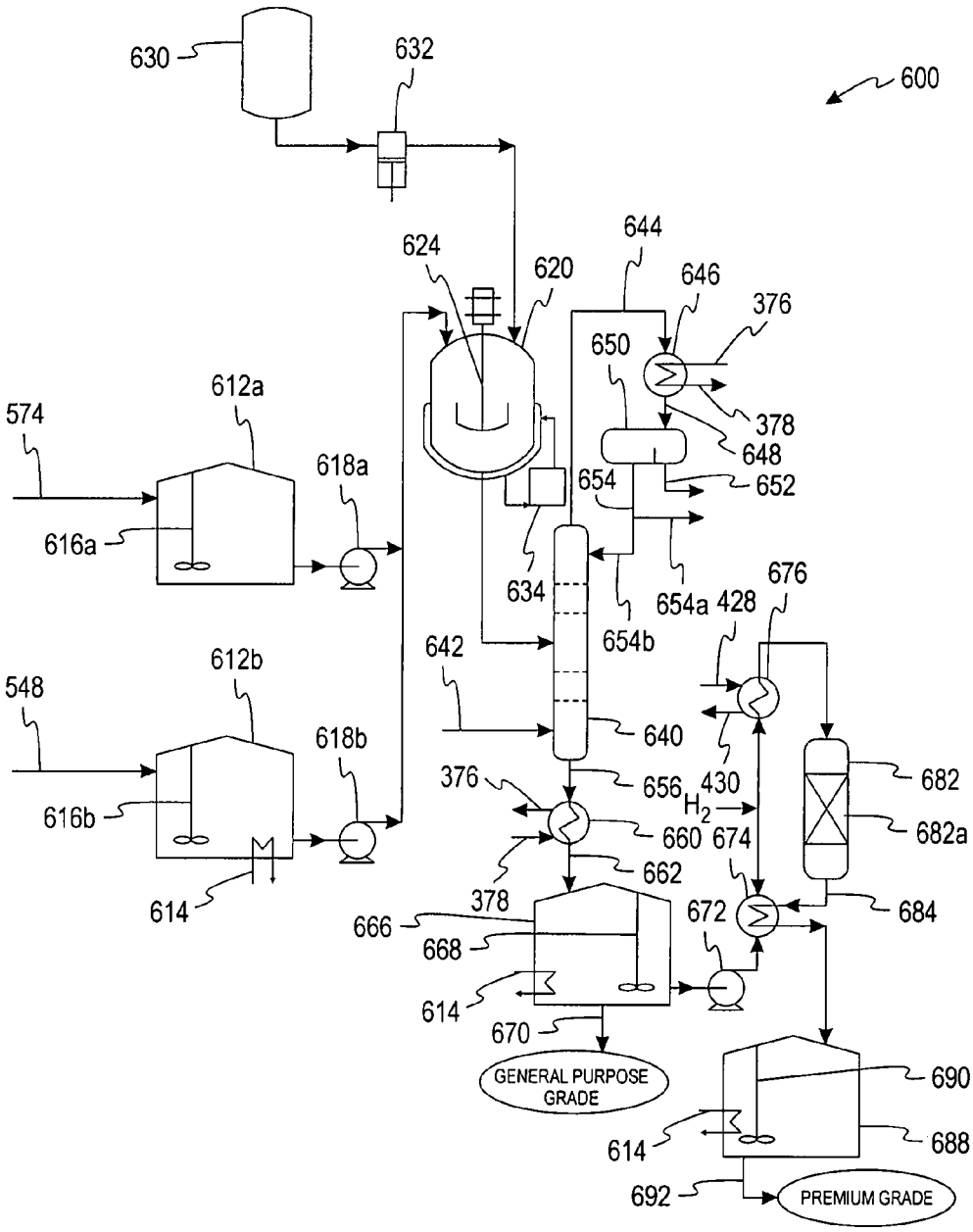
FIG. 6 is a process schematic of a petroleum-jelly production system for the conversion of a light-hydrocarbons stream and a heavy-hydrocarbons stream into petroleum jelly, according to one embodiment of the present invention.

Turning now to FIG. 6, a petroleum-jelly production system 600 for the conversion of the light-hydrocarbons stream 574 and the heavy-hydrocarbons stream 548 into petrolatum is illustrated, according to one embodiment of the present invention. In the illustrated embodiment, the light-hydrocarbons stream 574 exits the hydrocarbon conversion system 500 and is stored in one or more storage tanks 612*a*. The light-hydrocarbons stream 574, in some embodiments, has the $C_4$ and smaller hydrocarbons removed from the stream prior to being stored in the one or more storage tanks 612*a*, such that only $C_5$-$C_{22}$ hydrocarbons are stored within the one or more storage tanks 612*a*. This separation can be performed in a variety of ways as is generally known to those of ordinary skill in the art. In other embodiments, olefins in the $C_6$-$C_{10}$ range may be supplied to the one or more storage tanks 612*a* in addition to, or instead of, the Fischer-Tropsch $C_5$-$C_{22}$ hydrocarbons. The heavy-hydrocarbons stream 548 exits the hydrocarbon conversion system 500 and enters the petroleum-jelly production system 600 and is stored in another of the one or more storage tanks 612*b*. In other embodiments of the present invention, both the light-hydrocarbons stream 574 and the heavy-hydrocarbons stream 548 may be stored together in the same storage tank(s).

Each of the one or more storage tanks 612*a-b*, which could potentially contain hydrocarbons with melting points near ambient temperature or higher, includes a mixing mechanism 616*a-b*, respectively, for assisting in keeping the stored hydrocarbons in a liquid state. The mixing mechanism 616*a-b* may be one or more stirring mechanisms or pumping mechanisms adapted to circulate the stored hydrocarbons within the one or more storage tanks 612*a-b*. Additionally, the one or more storage tanks 612*a-b* may be provided with an external heat source (e.g., external heat source 614 in storage tank 612*b*) adapted to provide heat to the one or more storage tanks 612*a-b* to assist in keeping the stored hydrocarbons in a liquid state.

The hydrocarbons stored within the one or more storage tanks 612*a-b*, according to some embodiments, are kept at or above a temperature of about 70° F. (about 21° C.). It should be noted that the heavier the hydrocarbons stored in the one or more storage tanks 612*a-b* and the longer the hydrocarbons are stored in the one or more storage tanks 612*a-b*, the more desirable an external heat source becomes, as is generally understood by those skilled in the art. Synthetic waxes such as those derived from vegetable oils and animal fats may be supplied to the hydrocarbons stored within the one or more storage tanks 612*a-b*. Synthetic waxes such as those derived from vegetable oils and animal fats may be supplied to the heavier hydrocarbons stored within the one or more storage tanks 612*a-b* in addition to or instead of the Fischer-Tropsch $C_5$-$C_{22}$ hydrocarbons. One or more pumps 618*a-b* are provided to transfer some or all of the stored hydrocarbons from the one or more storage tanks 612*a-b* to a graft reactor 620, which may be a batch reactor or a continuous-flow static mixer.

The graft reactor 620 is designed to facilitate the grafting of olefins onto long-chain hydrocarbons using one or more organic peroxide initiators such as, but not limited to, dialkyl peroxides, 2,5-dimethyl 2,5-di(t-butylperoxy)hexane, di-t-butyl peroxide, dicumyl peroxide, dipropyl peroxide, ethyl propyl peroxide, tert-butyl ter-amyl peroxide, etc., that have the general formula R—O—O—R with R being an alkyl, aryl or acyl group. The dialkyl peroxide initiator is stored in an initiator storage tank 630 and is transferred into the graft reactor 620 by a metering mechanism 632 adapted to allow the one or more stored peroxide initiators to be fed from the initiator storage tank 630 into the graft reactor 620. The graft reactor 620 includes a mixing mechanism 624 adapted to mix the light and heavy hydrocarbons transferred from the one or more storage tanks 612*a-b* with the dialkyl peroxide initiator fed from the initiator storage tank 630. A heating medium 634 such as, but not limited to, hot oil, hot water, steam, or other heat-producing mechanism may be provided to the graft reactor 620 to assist in maintaining the temperature of the contents of the graft reactor 620 at the predetermined reaction temperatures, as will be described below.

To produce a petroleum jelly according to the present invention, hydrocarbons organic peroxide initiator. The initiator, in some embodiments, is a dialkyl peroxide and the graft reactor is at a temperature high enough to break down the peroxide into radicals. The hydrocarbons are substantially olefins and paraffins that form petrolatum when reacted in the presence of the dialkyl peroxide initiator. For example, where the olefin is 1-hexene and the paraffin is eicosane (n-$C_{20}$), the reaction scheme is believed to proceed as follows:

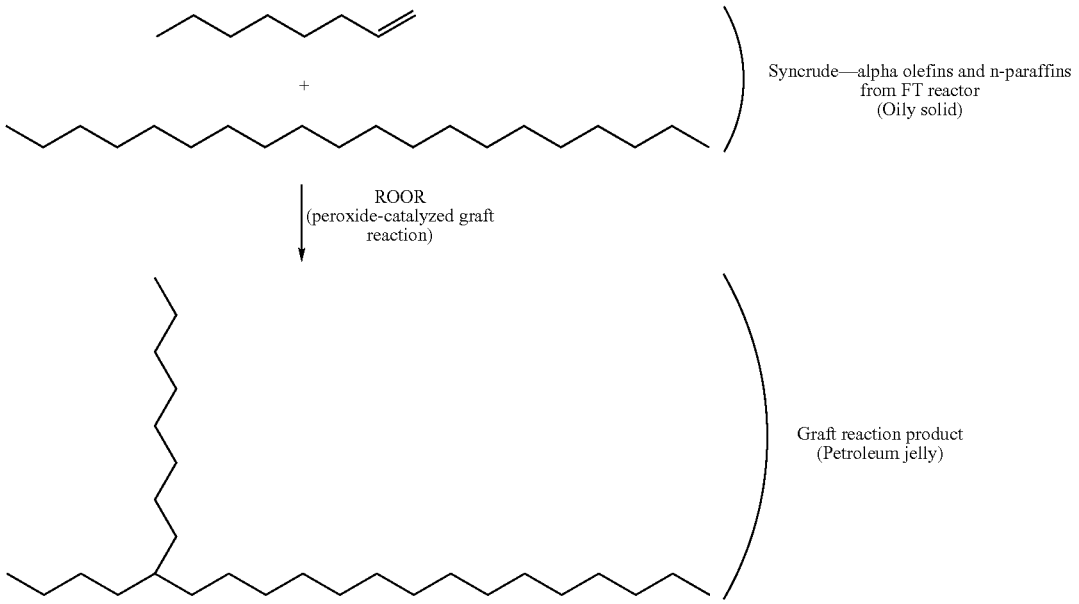

To generate the petroleum jelly, the graft reactor 620 is generally kept at a temperature of between about 200° F.

(about 93° C.) and about 400° F. (about 204° C.) and at a pressure of between about 0 to about 50 psig. According to one embodiment, the temperature of the contents within the graft reactor 620 are maintained at between about 250° F. (about 121° C.) and about 350° F. (about 177° C.). According to one embodiment, the reaction is allowed to cycle within the graft reactor 620 from between about 2 hours to about 8 hours and, in some embodiments, is allowed to cycle for a sufficient period of time for all the hydrocarbons to couple and thus convert the wax to petroleum jelly. In general, the reaction time requirement is reduced by increasing reactor temperature. Further, according to one embodiment, the dialkyl peroxide initiator concentration within the graft reactor 620 is between about 0.5 to about 5 weight percent of the contents of the graft reactor 620. The peroxide initiator may be added into the graft reactor 620 all at once, in increments, or continuously during the reaction cycle. Similarly, the olefin-rich light hydrocarbons may also be added to the reactor all at once, in increments, or continuously during the reaction. Continuous or incremental addition of the olefins is believed to promote the graft reaction versus competing olefin polymerization reactions. The ratio of the light hydrocarbons to heavy hydrocarbons may be adjusted to affect product consistency. According to one embodiment, the graft reactor 620 is adapted to contain between about 1,000 gallons to about 10,000 gallons of the petrolatum/hydrocarbon/initiator mixture.

In some embodiments, a continuous-flow static mixer is utilized instead of the illustrated batch reactor (e.g., the graft reactor 620). Where a continuous-flow static mixer is used, the hydrocarbons and initiator are mixed within the continuous-flow static mixer and are allowed to react and form petrolatum as the contents move along the tube of the static mixer. The length of the tube should be selected so as to facilitate a reaction time of at least about 0.5 to about 3 hours to allow the hydrocarbons to form the petrolatum. In some embodiments, multiple static reactors in series are used with peroxide and olefinic light hydrocarbons injected between each reactor.

Once the contents of the graft reactor 620 have reacted for the pre-selected length of time (or the contents reach the end of the continuous-flow static mixer), the petrolatum/hydrocarbon/initiator mixture is fed to a distillation column 640 for separation and further processing. The distillation column 640 is adapted to separate the petrolatum (generally the $C_{20+}$ fraction) from the unreacted hydrocarbons and the initiators. A super-heated steam stream 642 is fed into a lower portion of the distillation column 640 to maintain the temperature within the distillation column 640 at between about 200° F. (about 93° C.) and about 700° F. (about 371° C.) and, in some embodiments, between about 300° F. (about 149° C.) and about 600° F. (about 315° C.). At these temperatures, a portion of the contents within the distillation column 640 are in a vapor phase while a second portion are in a liquid phase. In an alternative embodiment, vacuum distillation is used to substantially remove the $C_{19}$-components from petrolatum.

A vapor stream 644 is formed by the lighter fractions among the contents of the distillation column 640 that diffuse into the upper part of the distillation column 640 and are continuously drawn off and directed to other units for further processing. These vapor phase contents substantially include the unreacted hydrocarbons, the peroxide initiator, and water vapors. The vapor stream 644 is cooled by a cooling-water heat exchanger 646 or other cooling mechanism. The cooling-water heat exchanger 646 transfers heat from the vapor stream 644 to a cooling water supply 376 supplied to the cooling-water heat exchanger 646. The cooling water temperature is maintained above the congealing point of the $C_{20}$-stream, typically in the about 110° F. (about 43° C.) to the about 120° F. (about 49° C.) range, to prevent "freeze-up" in the condenser. The temperature of the cooling water supply 376 increases and the cooling water supply 376 exits the cooling-water heat exchanger 646 via a cooling water return 378. The cooling of the vapor stream 644 is sufficient to cause a majority of the vapor stream 644 to condense into a condensed vapor stream 648 prior to reaching a separator 650.

The separator 650 is provided to divide the condensed vapor stream 644 into its component parts. As the condensed vapor stream 644 enters the separator 650, the initiator and its decomposition products, and any condensed water within the condensed vapor stream 644 sink to the bottom of the separator 650 where they can be removed from the separator 650 via a water stream 652. The hydrocarbons, however, being less dense than the water and initiator and also being non-polar, remain atop the condensed water and initiator within the separator 650. As the level of the condensed materials in the separator 650 rises, the hydrocarbons eventually spill over a weir and exit the separator via a condensed hydrocarbons stream 654. A first portion 654*a* of the condensed hydrocarbons stream 654 is removed from the petroleum-jelly production system 600 and, in some embodiments, is further processed downstream. A second portion 654*b* of the condensed hydrocarbons stream 654 is returned to the distillation column 640 to facilitate the reflux within the distillation column 640.

Within the distillation column 640, the petrolatum sinks to the bottom of the distillation column 640 as it has a higher density, boiling point, and molecular weight than the unreacted hydrocarbons, initiator, and water. A petrolatum stream 656 exits the distillation column 640 and is cooled by a cooling-water heat exchanger 660 or other cooling mechanism. The cooling-water heat exchanger 660 transfers heat from the petrolatum stream 656 to cooling water supply 376 or another heat transfer fluid supplied to the cooling-water heat exchanger 660. The cooling heat transfer fluid temperature is maintained above the congealing point of the petrolatum, typically from about 130° F. (about 54° C.) to about 150° F. (about 66° C.), to prevent "freeze-up" in the exchanger. The temperature of the cooling water supply 376 increases as the cooling water supply 376 exits the cooling-water heat exchanger 660 via a heat transfer fluid return 378. A resultant cooled petrolatum stream 662 is then fed into a storage tank 666.

The storage tank 666 is similar to the one or more storage tanks 612*b* in that the storage tank 666 includes a mixing mechanism 668 and a heat source 614 is provided to the storage tank 666. The mixing mechanism 668 and heat source 614 assist in keeping the stored petrolatum from congealing. The petrolatum is generally maintained in the molten form at a temperature above about 140° F. (about 60° C.) and, in some embodiments, above about 160° F. (about 71° C.). The typical storage temperature is in the about 140° F. (about 60° C.) to the about 160° F. (about 71° C.) range. The petrolatum may be removed from the storage tank 666 via a general-purpose petrolatum stream 670. At this stage, the petrolatum is a general-purpose grade petroleum jelly and can be used in, for example, paper manufacturing, candle making, electrical goods, rubber compounding, textiles, etc.

Alternatively, the petrolatum may be removed from the storage tank 666 by a pump 672 for further processing and purification. The petrolatum to be further processed is first sent through a heat exchanger 674 and, in some embodiments, the petrolatum may then be sent through a hydrogenation pre-heater 676. Where the hydrogenation pre-heater 676 is a heat exchanger, the hydrogenation pre-heater 676 is fed by a steam stream 428 that supplies heat to the petrolatum within the hydrogenation pre-heater 676. A resultant condensate stream 430 exits the hydrogenation pre-heater 676. The combination of the heat exchanger 674 and the hydrogenation pre-heater 676 are adapted to heat the petrolatum to a temperature between about 200° F. (about 93° C.) to about 600° F. (about 315° C.) and, in some embodiments, to between about 300° F. (about 149° C.) and about 500° F. (about 260° C.).

Once the petrolatum has been sufficiently heated, it is fed into a hydrogenation reactor 682 adapted to saturate any remaining double bonds within the petrolatum. The hydrogenation step also removes any color or odor from the product. The hydrogenation reactor 682 includes a catalyst bed 682*a* comprising, for example, noble metals, nickel, cobalt, or copper on an extrude support. Fixed-bed catalyst supports typically include aluminum or silicon oxides. The hydrogenation reactor 682 may also be a slurry reactor. Slurry hydrogenation catalysts include noble metals, nickel, cobalt, or copper on powder supports such as aluminum or silicon oxides. Other slurry hydrogenation catalysts include platinum black, palladium black, Raney® nickel, Raney® cobalt, etc. According to one embodiment, the catalyst bed 682*a* of the hydrogenation reactor 682 comprises a palladium on alumina catalyst. The hydrogenation reactor 682 is operated at a pressure of between about 100 psig and about 4,000 psig and, in some embodiments, between about 1,000 psig and about 2,000 psig. Liquid hourly space velocities for fixed-bed hydrogenation are in the about 0.5 to the about 5 vol/vol/hr range, while the hydrogen to liquid feed ratios are in the about 30 to about 200 range.

A resultant hydrogenated petrolatum stream 684 exits a lower portion of the hydrogenation reactor 682 and is fed to the heat exchanger 674 where it heats the petrolatum being pumped from the storage tank 666. The hydrogenated petrolatum stream 684 is then fed into a storage tank 688 having a mixing mechanism 690 and a heat source 614. The hydrogenated petrolatum stored within the storage tank 688 may then be removed via a premium-grade petrolatum stream 692. At this stage, the petrolatum is a premium grade petroleum jelly and can be used in, for example, pharmaceuticals, cosmetics, etc.

One of the key attributes of petrolatum is its fibrous texture or "feathering." Although cone penetration and other penetrometer techniques may be used to characterize a semi-solid, feathering is more qualitative.

As illustrated above, petrolatum has been produced by converting the syncrude products (e.g., light and heavy hydrocarbons) generated from a natural gas source via a Fischer-Tropsch reaction. As the natural gas feedstock used to create the petroleum jelly is inherently less toxic than other petroleum feedstock, it is possible that the petroleum jelly manufactured by the above-described techniques need not be classified as a human carcinogen and, as such, should be able to be utilized effectively within cosmetics and other products at various locations, including within the European Union.

EXAMPLES

Example 1

A syncrude consisting of 148.1 g of Fischer-Tropsch heavy-hydrocarbons in wax form and 84.9 g of Fischer-Tropsch light-hydrocarbons in oil form was added to a 500 mL 3-necked round bottom flask and melted. (Table I is a typical Fischer-Tropsch light-hydrocarbon composition.)

TABLE I

Typical Composition of Fischer-Tropsch Light-Hydrocarbon Stream (Normalized Weight Percent)

| Carbon No. | paraffins | olefins |
|---|---|---|
| C4 | 0.17% | 0.27% |
| C5 | 0.72% | 0.64% |
| C6 | 2.34% | 1.51% |
| C7 | 5.31% | 2.81% |
| C8 | 7.82% | 3.17% |
| C9 | 9.01% | 2.86% |
| C10 | 9.46% | 2.13% |
| C11 | 9.07% | 1.69% |
| C12 | 8.32% | 1.31% |
| C13 | 7.36% | 0.95% |
| C14 | 5.98% | 0.65% |
| C15 | 4.60% | 0.44% |
| C16 | 3.48% | 0.28% |
| C17 | 2.74% | 0.11% |
| C18 | 1.89% | 0.14% |
| C19 | 1.03% | 0.11% |
| C20 | 0.83% | 0.04% |
| C21 | 0.47% | 0.01% |
| C22 | 0.26% | 0.01% |

A sample of this syncrude was taken at 74° C. (165° F.). When the temperature reached 145° C. (293° F.), 15 mL LUPEROX-101 dialkyl peroxide (purchased from Aldrich catalogue) was added to the syncrude mixture. The mixture was allowed to reflux at this temperature for 3 hours. Samples were taken after each hour for analysis.

The untreated syncrude had a congealing temperature of about 60° C. (140° F.). The final product had a congealing point of 62° C. (144° F.). The final product was a semi-solid with the texture and properties of petroleum jelly. When applied to the skin, some of the jelly composition appeared to melt and result in an oily feel. The product had an odor similar to that of the Fischer-Tropsch oil. The odor was significantly reduced after stripping (vacuum distilling) the oil from the jelly.

Example 2

148.4 g of Fischer-Tropsch (FT) heavy-hydrocarbon wax was added to a 500 mL 3-necked round bottom flask and melted. A sample of this wax was taken. When the temperature reached 145° C. (293° F.), 5 mL LUPEROX-101 was added to the flask. The liquid was maintained at this temperature and allowed to reflux. After five minutes, 10 mL of 98% 1-octene was added. Another 10 mL of 98% 1-octene was added every 10 minutes, for a total of 50 mL added. When all of the 1-octene had been added, 5 mL of LUPEROX-101 was the added. After another hour of reflux at 145° C. (293° F.), the final 5 mL of LUPEROX-101 was added. The mixture was then allowed to reflux for one more hour.

The untreated wax had a congealing temperature of 64° C. (147° F.). The treated sample had a congealing point of 58.5° C. (137° F.). The final product was a semi-solid with the texture and properties of petroleum jelly. The product did not melt on skin contact.

Example 3

99.4 g of heavy Fischer-Tropsch heavy-hydrocarbons in wax form was added to a 250 mL round bottom flask. The sample was distilled using a Vigreux distillation column under 23 inches of mercury vacuum. Light hydrocarbons were evaporated, condensed, and then collected in a second flask. 90.9 g of distilled Fischer-Tropsch wax was recovered.

Example 4

The Fischer-Tropsch wax from Example 3 was transferred to a 500 mL 3-necked round bottom flask and heated to melt. A sample of this wax was taken. When the temperature reached 145° C., 5 mL LUPEROX-101 was added to the flask. The liquid in the flask was maintained at this temperature and allowed to reflux. 35 g of light Fischer-Tropsch oil was measured out. 10 mL of Fischer-Tropsch oil was then added to the reaction flask. Another 10 mL of Fischer-Tropsch oil was added every 10 minutes, until all 35 g had been added. 5 mL of LUPEROX-101 was then added to the flask. After another hour of reflux at 145° C. (293° F.), the final 5 mL of LUPEROX-101 was added. The mixture refluxed for one more hour at 165° C. (329° F.). Samples were taken after each hour for analysis. The distilled wax had a congealing point of 65° C., and the final product had a congealing point of 54° C. (129° F.).

Example 5

41.8 g of the petrolatum created in Example 4 was added to a 250 mL round bottom flask. The petrolatum was then vacuum distilled to remove unreacted oil. Distillation greatly reduced the odor of the petrolatum. The final product was a semi-solid with the texture and properties of petroleum jelly. The product did not melt on skin contact.

The final products of Examples 1, 2 and 5 were semi-solids with the texture and properties of petroleum jelly (i.e., consistency at 77° F. or 25° C.). Visually, the color was not yellow like currently produced commercial petroleum jelly (e.g., Vaseline®), but white instead. It is believed that even further lightening of the petrolatum would be produced by the subsequent hydrogenation of the graft reaction product. The properties of these products are presented in Table II. Table II also includes comparative properties of a commercial petroleum-based petrolatum as well as a commercial non-petroleum petrolatum product (based on natural waxes and oils).

TABLE II

Properties of Synthetic and Conventional Petrolatum

Figure 7:
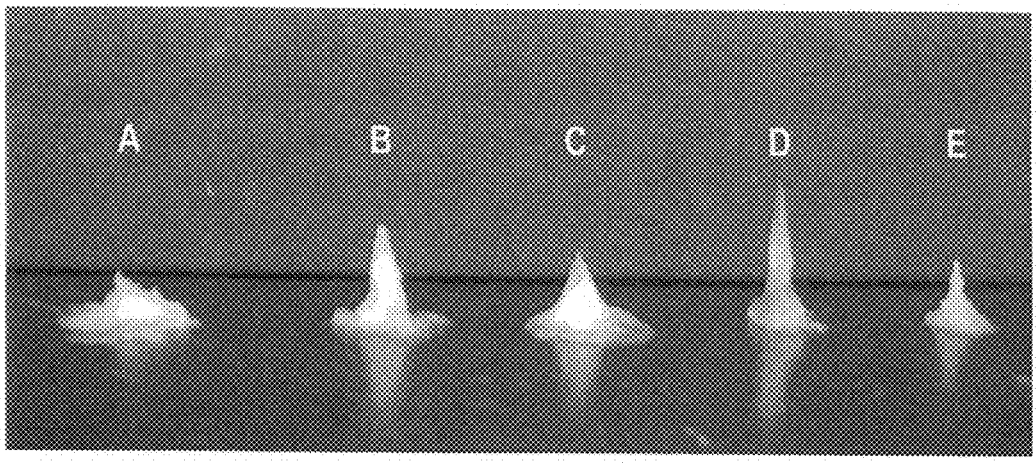
FIG. 7 is a color photographic image illustrating the visual characteristics of the petrolatum end products, according to some embodiments, in comparison with two commercially marketed petroleum jellies.

| Example | Congealing Point (° C.) | Consistency Description | Photo Reference |
|---|---|---|---|
| 1 | 62 | minimal feathering, melts on skin | A (see FIG. 7) |
| 2 | 58.5 | good feathering, did not melt on skin | B (see FIG. 7) |
| 5 | 54 | average feathering, did not melt on skin | C (see FIG. 7) |
| Commercial petrolatum[a] | 51.5 | excellent feathering | D (see FIG. 7) |
| Commercial non-petroleum petrolatum[b] | 52 | minimal feathering, melts on skin | E (see FIG. 7) |

[a]Walgreens ® brand 100% Pure Petroleum Jelly
[b]Avalon ® brand Un-Petroleum Multi-Purpose Jelly While the present invention has been described with reference to one or more particular embodiments, those skilled in the art will recognize that many changes may be made thereto without departing from the spirit and scope of the present invention. Each of these embodiments and obvious variations thereof is contemplated as falling within the scope of the claimed invention, which is set forth in the following claims.

The invention claimed is:

1. A method for producing petroleum jelly from a natural gas source comprising:

converting the natural gas source into a synthesis gas;

converting the synthesis gas into at least a light-hydrocarbons oil stream and a heavy-hydrocarbons wax stream, the light-hydrocarbons stream and the heavy-hydrocarbons stream including a plurality of paraffins and a plurality of olefins; and reacting the plurality of paraffins with the plurality of olefins in the presence of a dialkyl peroxide initiator to form the petroleum jelly.

2. The method of claim 1, further comprising stripping the petroleum jelly in a fractionation column.

3. The method of claim 2, further comprising hydrogenating at least a portion of the produced petroleum jelly to crack and saturate at least some remaining double bonds within the petroleum jelly and to remove odor.

4. The method of claim 1, wherein the reaction between the plurality of paraffins and the plurality of olefins occurs within a batch reactor.

5. The method of claim 3, wherein the entirety of the dialkyl peroxide initiator is added at the same time.

6. The method of claim 3, wherein the dialkyl peroxide initiator is added continuously.

7. The method of claim 3, wherein the dialkyl peroxide initiator is added in increments.

8. The method of claim 1, wherein the entirety of the light-hydrocarbons stream is olefin-rich and is added to a reactor along with the heavy-hydrocarbons stream.

9. The method of claim 8, wherein the olefin-rich light-hydrocarbons stream is added to the reactor continuously.

10. The method of claim 8, wherein the olefin-rich light-hydrocarbons stream is added to the reactor in increments.

11. The method of claim 3, wherein the reaction is allowed to proceed for at least about 2 hours.

12. The method of claim 3, wherein the reaction is not allowed to proceed for longer than about 8 hours.

13. The method of claim 1, wherein the reaction between the plurality of paraffins and the plurality of olefins occurs within a continuous-flow static mixer, the reaction taking place as the plurality of paraffins and the plurality of olefins move along the continuous-flow static mixer.

14. A method for producing petroleum jelly comprising:

generating a synthesis gas from one or more of a group including at least natural gas, biomass, coal, or other hydrocarbon source;

converting the synthesis gas into at least a light-hydrocarbons oil stream and a heavy-hydrocarbons wax stream, the light-hydrocarbons stream and the heavy-hydrocarbons stream including a plurality of paraffins and a plurality of olefins; and reacting the plurality of paraffins with the plurality of olefins in the presence of a dialkyl peroxide initiator to form the petroleum jelly.

* * * * *